US008581821B2

(12) United States Patent
Kamada et al.

(10) Patent No.: US 8,581,821 B2
(45) Date of Patent: Nov. 12, 2013

(54) LIQUID CRYSTAL DISPLAY DEVICE, LIQUID CRYSTAL DISPLAY METHOD, DISPLAY CONTROL DEVICE, AND DISPLAY CONTROL METHOD

(75) Inventors: Tsuyoshi Kamada, Kanagawa (JP); Toshiaki Suzuki, Kanagawa (JP); Kazuhiro Nukiyama, Kanagawa (JP)

(73) Assignee: Sony Corporation, Tokyo (JP)

( * ) Notice: Subject to any disclaimer, the term of this patent is extended or adjusted under 35 U.S.C. 154(b) by 1003 days.

(21) Appl. No.: 12/409,186

(22) Filed: Mar. 23, 2009

(65) Prior Publication Data

US 2009/0237345 A1 Sep. 24, 2009

(30) Foreign Application Priority Data

Mar. 24, 2008 (JP) ..... P2008-075696
Mar. 24, 2008 (JP) ..... P2008-075697

(51) Int. Cl.
*G09G 3/36* (2006.01)

(52) U.S. Cl.
USPC ..... 345/94; 345/87; 345/92; 345/98; 345/100; 345/103

(58) Field of Classification Search
USPC ..... 345/87–104
See application file for complete search history.

(56) References Cited

U.S. PATENT DOCUMENTS 6,727,878 B2 * 4/2004 Okuzono et al. ..... 345/96
6,911,967 B2 * 6/2005 Okuzono et al. ..... 345/96
6,982,693 B2 * 1/2006 Okuzono et al. ..... 345/96
7,423,625 B2 * 9/2008 Lee et al. ..... 345/100
7,737,935 B2 * 6/2010 Kim ..... 345/96
7,804,473 B2 * 9/2010 Kumeta ..... 345/96
7,948,462 B2 * 5/2011 Tseng ..... 345/96
7,982,702 B2 * 7/2011 Kamada et al. ..... 345/89

(Continued)

FOREIGN PATENT DOCUMENTS

EP 2000881 12/2008
JP 63-55590 3/1988

(Continued)

OTHER PUBLICATIONS

English-language Extended European Search Report in corresponding EP 10 81 3645 mailed Sep. 30, 2011.

(Continued)

*Primary Examiner* — Bipin Shalwala
*Assistant Examiner* — Afroza Chowdhury
(74) *Attorney, Agent, or Firm* — Finnegan Henderson Farabow Garrett & Dunner LLP

(57) ABSTRACT

An LCD device includes a display unit including pixels having a multi-pixel structure; first and second driving units that drive scanning and signal lines, respectively; an image acquisition unit, and a control unit. Each of the pixels includes first and second pixels, and first and second pixels of pixels are connected to two corresponding signal lines in a checkerboard manner. The first driving unit is controlled to repeatedly scan a first sub-frame of odd lines and a second sub-frame of even lines, and the second driving unit is controlled in such a manner that the polarity of the first pixel of a pixel differs from that of the second pixel of the pixel, the polarities of the adjacent first pixels differ from each other and those of the adjacent second pixels differ from each other, and a polarity signal is inverted when switching is performed between first and second sub-frames.

21 Claims, 28 Drawing Sheets

(56) References Cited

U.S. PATENT DOCUMENTS

| | | | | |
|---|---|---|---|---|
| 2001/0004253 | A1* | 6/2001 | Fukutoku et al. | 345/96 |
| 2002/0024482 | A1 | 2/2002 | Song et al. | |
| 2003/0038766 | A1 | 2/2003 | Lee et al. | |
| 2005/0122295 | A1 | 6/2005 | Sawabe | |
| 2005/0122441 | A1 | 6/2005 | Shimoshikiryoh | |
| 2005/0174310 | A1 | 8/2005 | Huang et al. | |
| 2005/0206596 | A1* | 9/2005 | Chen et al. | 345/87 |
| 2005/0253797 | A1* | 11/2005 | Kamada et al. | 345/89 |
| 2006/0007094 | A1 | 1/2006 | Kang et al. | |
| 2006/0164352 | A1* | 7/2006 | Yoo et al. | 345/87 |
| 2006/0192775 | A1 | 8/2006 | Nicholson et al. | |
| 2006/0208984 | A1 | 9/2006 | Kim et al. | |
| 2007/0063952 | A1 | 3/2007 | Oku et al. | |
| 2007/0126884 | A1 | 6/2007 | Xu et al. | |
| 2008/0036933 | A1 | 2/2008 | Na et al. | |
| 2008/0074601 | A1 | 3/2008 | Lee et al. | |
| 2009/0160879 | A1 | 6/2009 | Tu et al. | |

FOREIGN PATENT DOCUMENTS

| | | |
|---|---|---|
| JP | 06-222330 | 8/1994 |
| JP | 6-222330 | 8/1994 |
| JP | 08-320674 | 12/1996 |
| JP | 09-015560 | 1/1997 |
| JP | 9-015560 | 1/1997 |
| JP | 11-102174 | 4/1999 |
| JP | 11-119193 | 4/1999 |
| JP | 11-352938 | 12/1999 |
| JP | 2002-091403 | 3/2002 |
| JP | 2002-91403 | 3/2002 |
| JP | 2004-4857 | 1/2004 |
| JP | 2004-004857 | 1/2004 |
| JP | 2005-316211 | 11/2005 |
| JP | 2006-349952 | 12/2006 |

OTHER PUBLICATIONS

European Search Report from the European Patent Office in European Application No. 09155833.8, (Apr. 2, 2012).

European Search Report issued Apr. 18, 2011 in corresponding European patent application No. EP 09 15 5833.

Hitachi Ltd., English-language translation and abstract of JP 06-222330 published on Aug. 12, 1994.

* cited by examiner

PRIOR ART

FIG. 11A

| | m1 | m2 | m1+1 | m2+1 | m1+2 | m2+2 | m1+3 | m2+3 | |
|---|---|---|---|---|---|---|---|---|---|
| n | + | − | + | − | + | − | + | − | ··· |
| n+1 | + | − | + | − | + | − | + | − | ··· |
| n+2 | + | − | + | − | + | − | + | − | ··· |
| n+3 | + | − | + | − | + | − | + | − | ··· |
| ⋮ | ⋮ | ⋮ | ⋮ | ⋮ | ⋮ | ⋮ | ⋮ | ⋮ | |

FIG. 11B

| | i=0 | i=1 | i=2 | i=3 | |
|---|---|---|---|---|---|
| n | + | − | + | − | ··· |
| n+1 | − | + | − | + | ··· |
| n+2 | + | − | + | − | ··· |
| n+3 | − | + | − | + | ··· |
| ⋮ | ⋮ | ⋮ | ⋮ | ⋮ | |

FIG. 11C

| | i=0 | i=1 | i=2 | i=3 | |
|---|---|---|---|---|---|
| n | − | + | − | + | ··· |
| n+1 | + | − | + | − | ··· |
| n+2 | − | + | − | + | ··· |
| n+3 | + | − | + | − | ··· |
| ⋮ | ⋮ | ⋮ | ⋮ | ⋮ | |

FIG. 12A

| | m1 | m2 | m1+1 | m2+1 | m1+2 | m2+2 | m1+3 | m2+3 | |
|---|---|---|---|---|---|---|---|---|---|
| n | − | + | − | + | − | + | − | + | ··· |
| n+1 | − | + | − | + | − | + | − | + | ··· |
| n+2 | − | + | − | + | − | + | − | + | ··· |
| n+3 | − | + | − | + | − | + | − | + | ··· |
| ⋮ | ⋮ | ⋮ | ⋮ | ⋮ | ⋮ | ⋮ | ⋮ | ⋮ | |

FIG. 12B

| | i=0 | i=1 | i=2 | i=3 | |
|---|---|---|---|---|---|
| n | − | + | − | + | ··· |
| n+1 | + | − | + | − | ··· |
| n+2 | − | + | − | + | ··· |
| n+3 | + | − | + | − | ··· |
| ⋮ | ⋮ | ⋮ | ⋮ | ⋮ | |

FIG. 12C

| | i=0 | i=1 | i=2 | i=3 | |
|---|---|---|---|---|---|
| n | + | − | + | − | ··· |
| n+1 | − | + | − | + | ··· |
| n+2 | + | − | + | − | ··· |
| n+3 | − | + | − | + | ··· |
| ⋮ | ⋮ | ⋮ | ⋮ | ⋮ | |

ROOM TEMPERATURE
NORMAL STATE

LOW TEMPERATURE
STATE IN WHICH
INCONSISTENCIES OCCUR

FIG. 18 k(1/2) FRAME

| | m | m+1 | m+2 | m+3 | ··· |
|---|---|---|---|---|---|
| n | + | − | + | − | ··· |
| n+2 | + | − | + | − | ··· |
| n+4 | + | − | + | − | ··· |
| n+6 | + | − | + | − | ··· |
| ⋮ | ⋮ | ⋮ | ⋮ | ⋮ | |

k(2/2) FRAME

| | m | m+1 | m+2 | m+3 | ··· |
|---|---|---|---|---|---|
| n+1 | − | + | − | + | ··· |
| n+3 | − | + | − | + | ··· |
| n+5 | − | + | − | + | ··· |
| n+7 | − | + | − | + | ··· |
| ⋮ | ⋮ | ⋮ | ⋮ | ⋮ | |

k+1(1/2) FRAME

| | m | m+1 | m+2 | m+3 | ··· |
|---|---|---|---|---|---|
| n | − | + | − | + | ··· |
| n+2 | − | + | − | + | ··· |
| n+4 | − | + | − | + | ··· |
| n+6 | − | + | − | + | ··· |
| ⋮ | ⋮ | ⋮ | ⋮ | ⋮ | |

k+1(2/2) FRAME

| | m | m+1 | m+2 | m+3 | ··· |
|---|---|---|---|---|---|
| n+1 | + | − | + | − | ··· |
| n+3 | + | − | + | − | ··· |
| n+5 | + | − | + | − | ··· |
| n+7 | + | − | + | − | ··· |
| ⋮ | ⋮ | ⋮ | ⋮ | ⋮ | |

| | m | m+1 | m+2 | m+3 | ··· |
|---|---|---|---|---|---|
| n | + | − | + | − | ··· |
| n+1 | + | − | + | − | ··· |
| n+2 | + | − | + | − | ··· |
| n+3 | + | − | + | − | ··· |
| ⋮ | ⋮ | ⋮ | ⋮ | ⋮ | |

| | m | m+1 | m+2 | m+3 | ··· |
|---|---|---|---|---|---|
| n | + | − | + | − | ··· |
| n+1 | − | + | − | + | ··· |
| n+2 | + | − | + | − | ··· |
| n+3 | − | + | − | + | ··· |
| ⋮ | ⋮ | ⋮ | ⋮ | ⋮ | |

| | m | m+1 | m+2 | m+3 | ··· |
|---|---|---|---|---|---|
| n | − | + | − | + | ··· |
| n+1 | − | + | − | + | ··· |
| n+2 | − | + | − | + | ··· |
| n+3 | − | + | − | + | ··· |
| ⋮ | ⋮ | ⋮ | ⋮ | ⋮ | |

| | m | m+1 | m+2 | m+3 | ··· |
|---|---|---|---|---|---|
| n | − | + | − | + | ··· |
| n+1 | + | − | + | − | ··· |
| n+2 | − | + | − | + | ··· |
| n+3 | + | − | + | − | ··· |
| ⋮ | ⋮ | ⋮ | ⋮ | ⋮ | |

FIG. 19A k(1/2) FRAME

| | m1 | m2 | m1+1 | m2+1 | m1+2 | m2+2 | m1+3 | m2+3 | |
|---|---|---|---|---|---|---|---|---|---|
| n | + | − | + | − | + | − | + | − | ··· |
| n+2 | + | − | + | − | + | − | + | − | ··· |
| n+4 | + | − | + | − | + | − | + | − | ··· |
| n+6 | + | − | + | − | + | − | + | − | ··· |
| ⋮ | ⋮ | ⋮ | ⋮ | ⋮ | ⋮ | ⋮ | ⋮ | ⋮ | |

FIG. 19B k(2/2) FRAME

| | m1 | m2 | m1+1 | m2+1 | m1+2 | m2+2 | m1+3 | m2+3 | |
|---|---|---|---|---|---|---|---|---|---|
| n+1 | + | − | + | − | + | − | + | − | ··· |
| n+3 | + | − | + | − | + | − | + | − | ··· |
| n+5 | + | − | + | − | + | − | + | − | ··· |
| n+7 | + | − | + | − | + | − | + | − | ··· |
| ⋮ | ⋮ | ⋮ | ⋮ | ⋮ | ⋮ | ⋮ | ⋮ | ⋮ | |

FIG. 19C

ONLY Px1

| | i=0 | i=1 | i=2 | i=3 | |
|---|---|---|---|---|---|
| n | + | − | + | − | ··· |
| n+1 | − | + | − | + | ··· |
| n+2 | + | − | + | − | ··· |
| n+3 | − | + | − | + | ··· |
| ⋮ | ⋮ | ⋮ | ⋮ | ⋮ | |

FIG. 19D

ONLY Px2

| | i=0 | i=1 | i=2 | i=3 | |
|---|---|---|---|---|---|
| n | − | + | − | + | ··· |
| n+1 | + | − | + | − | ··· |
| n+2 | − | + | − | + | ··· |
| n+3 | + | − | + | − | ··· |
| ⋮ | ⋮ | ⋮ | ⋮ | ⋮ | |

FIG. 20A k+1(1/2) FRAME

| | m1 | m2 | m1+1 | m2+1 | m1+2 | m2+2 | m1+3 | m2+3 | |
|---|---|---|---|---|---|---|---|---|---|
| n | − | + | − | + | − | + | − | + | ··· |
| n+2 | − | + | − | + | − | + | − | + | ··· |
| n+4 | − | + | − | + | − | + | − | + | ··· |
| n+6 | − | + | − | + | − | + | − | + | ··· |
| ⋮ | ⋮ | ⋮ | ⋮ | ⋮ | ⋮ | ⋮ | ⋮ | ⋮ | |

FIG. 20B k+1(2/2) FRAME

| | m1 | m2 | m1+1 | m2+1 | m1+2 | m2+2 | m1+3 | m2+3 | |
|---|---|---|---|---|---|---|---|---|---|
| n+1 | − | + | − | + | − | + | − | + | ··· |
| n+3 | − | + | − | + | − | + | − | + | ··· |
| n+5 | − | + | − | + | − | + | − | + | ··· |
| n+7 | − | + | − | + | − | + | − | + | ··· |
| ⋮ | ⋮ | ⋮ | ⋮ | ⋮ | ⋮ | ⋮ | ⋮ | ⋮ | |

FIG. 20C

ONLY Px1

| | i=0 | i=1 | i=2 | i=3 | |
|---|---|---|---|---|---|
| n | − | + | − | + | ··· |
| n+1 | + | − | + | − | ··· |
| n+2 | − | + | − | + | ··· |
| n+3 | + | − | + | − | ··· |
| ⋮ | ⋮ | ⋮ | ⋮ | ⋮ | |

FIG. 20D

ONLY Px2

| | i=0 | i=1 | i=2 | i=3 | |
|---|---|---|---|---|---|
| n | + | − | + | − | ··· |
| n+1 | − | + | − | + | ··· |
| n+2 | + | − | + | − | ··· |
| n+3 | − | + | − | + | ··· |
| ⋮ | ⋮ | ⋮ | ⋮ | ⋮ | |

FIG. 26A
| |
|---|
| 1ST BLOCK |
| 2ND BLOCK |
| 3RD BLOCK |
| 4TH BLOCK |
| 5TH BLOCK |
| 6TH BLOCK |
| 7TH BLOCK |
| 8TH BLOCK |
| 9TH BLOCK |
| 10TH BLOCK |
| 11TH BLOCK |
| 12TH BLOCK |
FIG. 26B
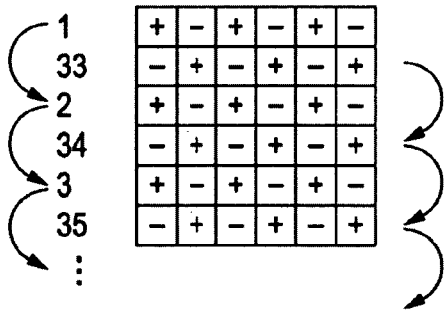
FIG. 26C
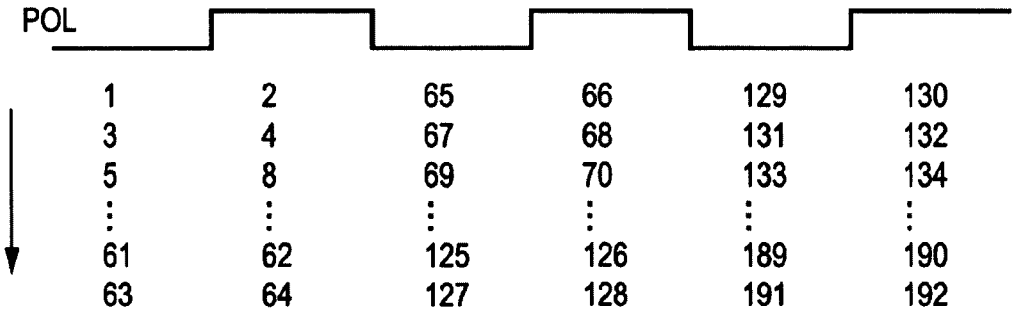

FIG. 30A

| DIVISION REGARDING ODD LINES | DIVISION REGARDING EVEN LINES |
|---|---|
| 1ST BLOCK ODD | 1ST BLOCK EVEN |
| 2ND BLOCK ODD | 2ND BLOCK EVEN |
| 3RD BLOCK ODD | 3RD BLOCK EVEN |
| 4TH BLOCK ODD | 4TH BLOCK EVEN |
| 5TH BLOCK ODD | 5TH BLOCK EVEN |
| 6TH BLOCK ODD | 6TH BLOCK EVEN |
| 7TH BLOCK ODD | 7TH BLOCK EVEN |
| 8TH BLOCK ODD | 8TH BLOCK EVEN |
| 9TH BLOCK ODD | 9TH BLOCK EVEN |
| 10TH BLOCK ODD | 10TH BLOCK EVEN |
| 11TH BLOCK ODD | 11TH BLOCK EVEN |
| 12TH BLOCK ODD | 12TH BLOCK EVEN |
| 13TH BLOCK ODD | |

FIG. 30B

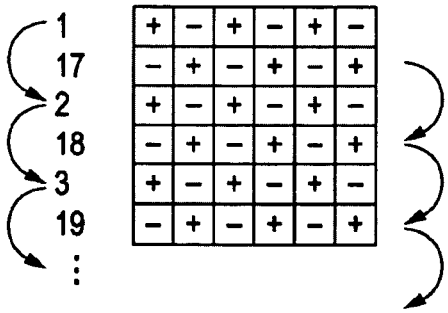

FIG. 30C

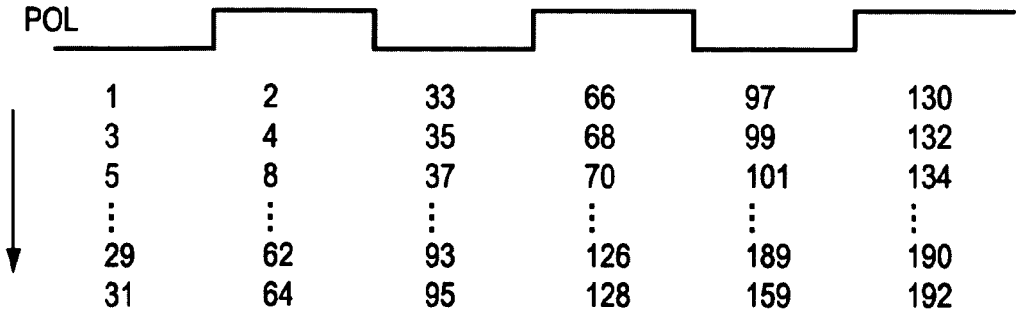

LIQUID CRYSTAL DISPLAY DEVICE, LIQUID CRYSTAL DISPLAY METHOD, DISPLAY CONTROL DEVICE, AND DISPLAY CONTROL METHOD

BACKGROUND OF THE INVENTION

1. Field of the Invention

The present invention relates to a liquid crystal display device, a liquid crystal display method, a display control device, and a display control method. The present invention relates more specifically to a liquid crystal display device, a liquid crystal display method, a display control device, and a display control method that are capable of suppressing the occurrence of inconsistencies in the form of streaks without the size of a thin-film transistor (TFT) being increased.

2. Description of the Related Art

FIG. 1 shows a schematic diagram of an active matrix of a liquid crystal display panel used in, for example, liquid crystal televisions or the like. Here, four rows denoted by n through n+3 and four columns denoted by m through m+3 are shown. Although the pixel positioned at (n+1, m+3) is used as an example to describe constituent elements that constitute one of pixels, the constituent elements of each of the pixels of the liquid crystal panel are the same as those of the pixel positioned at (n+1, m+3), as a matter of course.

A pixel electrode is provided to each of the pixels that perform display, and a liquid crystal capacitor 11 is formed between the pixel electrode and a common electrode opposite the pixel electrode with liquid crystal therebetween. For each pixel electrode, a TFT 12 that functions as a switch is formed, a gate electrode of the TFT 12 is connected to a gate bus line 14, a source electrode of the TFT 12 is connected to a source bus line 13, and a drain electrode of the TFT 12 is connected to the pixel electrode.

Representative examples of a pattern of the polarity arrangement of pixels in a case where liquid crystal is driven will be described using FIGS. 2 and 3.

The pattern of the polarity arrangement shown in FIG. 2 is the most common, and is called dot inversion driving. In the pattern of the polarity arrangement, pixels of positive polarity and pixels of negative polarity are arranged in a checkerboard manner. In dot inversion driving, for example, pixels positioned at the top, the bottom, the right, and the left of a pixel of positive polarity at an arbitrary position have negative polarity. Similarly, pixels positioned at the top, the bottom, the right, and the left of a pixel of negative polarity at an arbitrary position have positive polarity. This pattern has an advantage in that even when the absolute value of the voltage of pixels of positive polarity and the absolute value of the voltage of pixels of negative polarity are not balanced because of inconsistencies in the common voltage, inconsistencies or flicker tends not to occur. However, in dot inversion driving, since the polarity of the output of a source bus line is inverted between positive and negative polarities in units of one line, there is a disadvantage in that the power consumption of a driver integrated circuit (IC) becomes large. In particular, when high-speed writing at 120 Hz or higher is performed in order to realize high-speed responsivity, this disadvantage becomes a severe problem.

Thus, at the time of high-speed driving, as shown in FIG. 3, vertical line inversion driving in which the polarity of pixels arranged in the vertical direction is not inverted within one frame is often performed (for example, see Japanese Unexamined Patent Application Publication No. 63-55590).

When liquid crystal driving is performed, it is ideal that the electric potential whose value is the center point between the positive and negative voltages applied to pixels is applied to the common electrode formed on the counter substrate, liquid crystal being provided between the pixel and common electrodes. When the value of a voltage applied to the common electrode has the central electric potential, the effective voltage applied to the liquid crystal is balanced in terms of positive and negative polarities and brightness does not vary between frames even when display is continuously performed at the same tone. However, it is significantly difficult to make the common voltage be optimal over the entire display unit because of various factors such as use of a transparent electrode ITO whose resistance is relatively high as the common electrode, the resistance of bus lines near TFTs, the parasitic capacitance of TFTs, TFT leakage, variations in liquid crystal capacitance. In this case, the effective voltage applied to a pixel of positive polarity is different from the effective voltage applied to a pixel of negative polarity pixel, and thus there is a problem in that the variations in brightness occur in units of one frame, that is, flicker occurs.

In dot inversion driving described using FIG. 2, positive and negative polarities are finely and evenly arranged in a mixed manner and the variations in brightness cancel each other out, whereby the degree of perception of flicker is greatly reduced. However, when vertical line inversion is employed, flicker occurs in the form of vertical streaks since positive polarities or negative polarities are continuously arranged in each vertical column.

The frequency at which flicker occurs is half the frequency of the driving frequency, and thus in the case of a normal driving frequency of 60 Hz, flicker occurs at a frequency of 30 Hz. Thus, the degree of perception of flicker is very high. In contrast, when the driving frequency becomes high such as 120 Hz or 240 Hz, flicker occurs at a frequency of 60 Hz or 120 Hz, whereby it is not perceived as flicker by the human eye. That is, even when vertical line inversion is employed, if display is performed at high frequencies, general flicker becomes unrecognizable.

In a VA mode, there is a disadvantage regarding the viewing-angle characteristics in halftones. In order to improve the viewing-angle characteristics in halftones, multi-pixel technology is widely used. FIG. 4 is a drawing illustrating a principle of a multi-pixel structure used for achieving a wide viewing angle in liquid crystal televisions and the like. A pixel is divided into two, for example, a sub-pixel A and a sub-pixel B. Regarding an input tone, the pixel is configured in such a manner that the brightness of the sub-pixel A first increases and-then the brightness of the sub-pixel B increases, and thus the entire brightness is adjusted so as to satisfy a gamma characteristic.

There are a plurality of ways to differentiate the electric potential of the sub-pixel A from the electric potential of the sub-pixel B. For example, a dedicated TFT is provided for each sub-pixel as shown in FIG. 5A and, as shown in an equivalent circuit of FIG. 5C, two source bus lines are provided for the same gate bus line using the pattern of the counter electrode ITO as shown in FIG. 5B. By driving TFTs for the sub-pixels A and B, the electric potential of the sub-pixel A can be differentiated from the electric potential of the sub-pixel B.

More specifically, in FIG. 5A, a pixel electrode for the sub-pixel A is denoted by Px1, and a pixel electrode for the sub-pixel B is denoted by Px2. A TFT for driving the pixel electrode Px1 is denoted by TFT1, and a TFT for driving the pixel electrode Px2 is denoted by TFT2. In the pixel electrodes Px1 and Px2, there are slits for inclining liquid crystal at an angle of 45 degrees, which is unique to the VA mode, and part of the slits are also used as slits for separating the pixel electrode Px1 from the pixel electrode Px2. Similarly, liquid-crystal orientation regulation means is necessary for the common electrode provided on the counter substrate. In FIG. 5A, the slits are indicated by broken lines, and the slits only for the counter electrode are shown in FIG. 5B. Here, an insulator protrusion may be formed on the common electrode as orientation regulation means. As shown in the equivalent circuit of FIG. 5C, the pixel electrodes Px1 and Px2 are electrically independent, and what voltages are to be applied to the pixel electrodes Px1 and Px2 are determined by a control circuit.

SUMMARY OF THE INVENTION

As described above, vertical line inversion has an advantage over dot inversion in terms of power consumption. However, a problem may occur in a moving image regardless of frame frequency. For example, as shown in FIG. 6, when an area having a uniform tone (in this case, a box-shaped area indicated by α in FIG. 6) moves by one dot per frame, inconsistencies in the form of vertical streaks of one-dot pitch clearly appear, as shown in FIG. 7, in this area α. This phenomenon is related to the moving speed of the area α. If the area α is still, the inconsistencies do not appear. If the moving speed is two dots per frame, the inconsistencies do not appear; however, if the moving speed is three dots per frame, the inconsistencies appear again.

A cause of this phenomenon will be described using FIGS. 8 and 9. First, when the common voltage of the common electrode is shifted to Vcom' from the central electric potential Vcom which is the center point between the positive and negative voltages, a difference occurs in brightness between the positive and negative polarities, as shown in FIG. 8. As described above, if the driving frequency is high to a certain level (for example, in the case of driving at 120 Hz, flicker occurs at a frequency of 60 Hz), when the area α is still, this difference in brightness is not perceived by the human eye.

However, it has been proved that when this area α moves by one dot per frame as shown in FIG. 9A, the line of sight of a person moves by one dot per frame in synchronization with the movement of the area α. As a result, the positions of bright and dark columns are fixed with respect to the outline of the area α whose shape is a box and on which a person focuses, whereby inconsistencies in the form of vertical streaks appear because of a difference in brightness between the positive and negative polarities. In contrast, as shown in FIG. 9B, when the area α moves by two dots per frame, the positions of bright and dark columns change with respect to the outline of the area α, inconsistencies in the form of vertical streaks do not appear.

In this way, vertical line inversion has an advantage over dot inversion in terms of power consumption; however, it is necessary to solve the problem of the occurrence of inconsistencies in the form of vertical streaks described using FIGS. 6 through 9B.

Regarding the above-described multi-pixel structure, similarly to the case described using FIG. 1, there is an arrangement in which only pixel electrodes Px1 are connected to a source bus line and only pixel electrodes Px2 are connected to the next source line; however, it is necessary to employ the arrangement of pixels shown in FIG. 10 in order to solve the problem of the occurrence of inconsistencies in the form of vertical streaks described using FIGS. 6 through 9B.

In FIG. 10, the pixel electrodes Px1 and Px2 each have a dedicated TFT. The pixel electrodes Px1 and Px2 are connected to right and left source bus lines in a checkerboard manner. Thus, for each source bus line, the pixel electrodes Px1 and Px2 are alternately connected such as Px1, Px2, Px1, Px2, and so on.

FIGS. 11A through 12C show patterns of writing polarity in FIG. 10. FIG. 11A shows a pattern of the polarity arrangement of all the polarities detected through each of the bus lines in the k-th frame. FIG. 11B shows a pattern of the polarity arrangement regarding only the pixel electrodes Px1 in the k-th frame. FIG. 11C shows a pattern of the polarity arrangement regarding only the pixel electrodes Px2 in the k-th frame. FIG. 12A shows a pattern of the polarity arrangement of all the polarities detected through each of the bus lines in the k+1-th frame. FIG. 12B shows a pattern of the polarity arrangement regarding only the pixel electrodes Px1 in the k+1-th frame. FIG. 12C shows a pattern of the polarity arrangement regarding only the pixel electrodes Px2 in the k+1-th frame. Here, bold pluses (+) and bold minuses (−) indicate the pixel electrodes Px1 and regular pluses (+) and regular minuses (−) indicate the pixel electrodes Px2.

As shown in FIGS. 11A and 12A, the output of source bus lines indicates vertical line inversion, and it is advantageous in terms of power consumption. As shown in FIGS. 11B and 11C and FIGS. 12B and 12C, the polarities of the pixels for the pixel electrodes Px1 are arranged in a checkerboard manner and the polarities of the pixels for the pixel electrodes Px2 are arranged in a checkerboard manner. Thus, even when the electric potential of the common electrode becomes shifted from the central electric potential Vcom, which is optimal, and a difference in brightness occurs, the difference in brightness is canceled out between pixels positioned within a short distance, whereby perceptible inconsistencies do not occur.

However, there is a new problem regarding the structure described using FIGS. 10 through 12C. More specifically, in the operation of writing described using FIGS. 11A through 12C, the polarity of the outputs of specific source bus lines is not inverted and consumption power is suppressed. For example, when the entire screen is white, that is, in the case of a tone of 255/255, the maximum voltage is applied to all pixels including the pixel electrodes Px1 and Px2; however, since there is no change in voltage and the maximum voltage is supplied to the bus lines on every occasion, it is almost not necessary for a driver IC to feed a current and power consumption is significantly small. However, when a halftone is displayed, it is necessary to differentiate the sub-pixel A from the sub-pixel B in terms of brightness in each pixel having a multi-pixel structure. Thus, for example, in the case of a tone of about 64/255, a tone difference is caused such as a tone of 240/255 for the pixel electrodes Px1 and a tone of 0/255 for the pixel electrodes Px2. An actual source driver operates with a large difference in electric potential such as 240/255, 0/255, 240/255, 0/255, and so on, whereby a power-consumption suppression effect decreases and the power consumption becomes almost the same as that in dot inversion driving.

In an image that is actually displayed (for example, an image received and displayed by a television tuner), a video whose images are all white is quite rare, and a video usually contains many halftones. Thus, the structure described using FIGS. 10 through 12C greatly decreases an advantage obtained as a result of employment of vertical line inversion in terms of the entire power consumption.

Moreover, with the structure described using FIGS. 10 through 12C, uniform display is performed as shown in FIG. 13A at room temperature; however, when the temperature is low, the inconsistencies in the form of streaks occur which correspond to the pitch with which drivers are implemented, as shown in FIG. 13B.

Using FIGS. 14A though 16B, a cause of the streaks in the forms of streaks will be described. FIGS. 14A and 14B show a voltage Vg of a gate bus line, a voltage Vs of a source bus line, and a voltage Vpx of a pixel electrode in a halftone (for example, a tone of 127/255) when an ideal waveform is input. FIG. 14A shows the operation of writing to a pixel electrode Px1, and FIG. 14B shows the operation of writing to a pixel electrode Px2. The voltage Vs of a source bus line changes by a large difference in electric potential in such a manner that the level of halftone changes such as 240/255, 0/255, 240/255, 0/255, and so on. In a state in which the write gate pulse is high, electric current flows between a pixel electrode and a corresponding source bus line via a TFT, and the voltage Vpx of the pixel electrode changes.

FIGS. 15A and 15B show the voltage Vg of a gate bus line, the voltage Vs of a source bus line, and the voltage Vpx of a pixel electrode in a halftone (for example, a tone of 127/255) when a delay time in a bus line is assumed. FIG. 15A shows the operation of writing to a pixel electrode Px1, and FIG. 15B shows the operation of writing to a pixel electrode Px2. When driving is performed at room temperature, the operation of writing is performed in a state that is almost similar to the state as shown in FIGS. 15A and 15B. In such a case, the gate pulse and the source voltage are attenuated at a portion where the gate pulse rises, and thus more time is necessary to charge a pixel electrode than in a state described using FIGS. 14A and 14B. However, normally, TFTs are designed to be able to perform the operation of writing even in such a state, and thus no problem occurs.

However, if the temperature further lowers, the mobility of TFTs decreases, whereby more time is necessary for charging. FIGS. 16A and 16B show the voltage Vg of a gate bus line, the voltage Vs of a source bus line, and the voltage Vpx of a pixel electrode in a halftone (for example, a tone of 127/255) when a delay time in a bus line is assumed and the performance of TFTs becomes low at low temperatures. FIG. 16A shows the operation of writing performed to a pixel electrode Px1, and FIG. 16B shows the operation of writing performed to a pixel electrode Px2. In the case shown in FIGS. 16A and 16B, the delayed voltage of a source bus line affects the operation of writing, whereby inconsistencies in the form of streaks as described using FIG. 13B occur.

As a matter of course, it is possible to decrease the inconsistencies in the form of streaks as shown in FIG. 13B by designing a TFT in such a manner that it mainly supports low temperatures. However, if the size of the TFT becomes large for the design, the risk of occurrence of different problems may arise. For example, the aperture ratio lowers, or the inconsistencies become worse because of an increased delay time which is caused by the increase in gate load. The higher the writing speed, for example, 120 Hz or 240 Hz, the greater the effect of such problems. Thus, conditions become worse.

The present invention has been made in light of such circumstances, and it is desirable to suppress the occurrence of inconsistencies in the form of streaks and to decrease a necessary capacity of a memory without the size of a TFT being increased.

A liquid crystal display device according to an embodiment of the present invention includes: display means including liquid crystal display elements corresponding to pixels which have a multi-pixel structure and which are arranged in matrix; first driving means for driving scanning lines connected to the liquid crystal display elements corresponding to the pixels; second driving means for driving signal lines connected to the liquid crystal display elements corresponding to the pixels; image acquisition means for acquiring an image signal to be displayed on the display means; and control means for controlling the first driving means and the second driving means in accordance with the image signal acquired by the image acquisition means, wherein, in the display means, each of the pixels, which has the multi-pixel structure and which is constituted by a first pixel and a second pixel, is connected to two corresponding signal lines, and first pixels and second pixels of pixels are connected to two corresponding signal lines in a checkerboard manner, and the control means controls the first driving means in such a manner that all horizontal scanning lines of one frame are scanned by repeatedly scanning a first sub-frame in which only odd lines of horizontal scanning lines are scanned and a second sub-frame in which only even lines of horizontal scanning lines are scanned, and controls the second driving means in such a manner that the polarity of the first pixel of each of the pixels connected to the two corresponding signal lines differs from the polarity of the second pixel of the pixel, the polarities of the first pixels of adjacent pixels differ from each other, the polarities of the second pixels of adjacent pixels differ from each other, and a polarity signal is inverted when switching is performed between the first sub-frame and the second sub-frame.

The control means may divide all horizontal scanning lines of the display means into a plurality of areas constituted by four lines or more, and control the first driving means in such a manner that all horizontal scanning lines of one frame are scanned by executing scanning of the first sub-frame and the second sub-frame in the plurality of areas.

The control means may set a time period for performing an operation of writing at the first horizontal scanning line after switching is performed between the first sub-frame and the second sub-frame, to be longer than a time period for performing the operation of writing at another horizontal scanning line.

The control means may divide all horizontal scanning lines of the display means into a plurality of areas constituted by two lines or more in such a manner that scanning areas of the first sub-frame and second sub-frame do not overlap each other, and control the first driving means in such a manner that all horizontal scanning lines of one frame are scanned by executing scanning of the first sub-frame and the second sub-frame in the plurality of areas.

The control means may set a time period for performing an operation of writing at the first horizontal scanning line after switching is performed between the first sub-frame and the second sub-frame, to be longer than a time period for performing the operation of writing at another horizontal scanning line.

A liquid crystal display method according to the embodiment of the present invention is a liquid crystal display method for displaying an image on a liquid crystal display device which includes display means including liquid crystal display elements corresponding to pixels which have a multi-pixel structure and which are arranged in matrix; first driving means for driving scanning lines connected to the liquid crystal display elements corresponding to the pixels; and second driving means for driving signal lines connected to the liquid crystal display elements corresponding to the pixels, and in the display means, each of the pixels, which has the multi-pixel structure and which is constituted by a first pixel and a second pixel, is connected to two corresponding signal lines, and first pixels and second pixels of pixels are connected to two corresponding signal lines in a checkerboard manner, the liquid crystal display method including the steps of: acquiring an image signal corresponding to the image to be displayed on the display means; when the first driving means and the second driving means are controlled in accordance with the acquired image signal, controlling the first driving means in such a manner that all horizontal scanning lines of one frame are scanned by repeatedly scanning a first sub-frame in which only odd lines of horizontal scanning lines are scanned and a second sub-frame in which only even lines of horizontal scanning lines are scanned; and controlling the second driving means in such a manner that the polarity of the first pixel of each of the pixels connected to the two corresponding signal lines differs from the polarity of the second pixel of the pixel, the polarities of the first pixels of adjacent pixels differ from each other, the polarities of the second pixels of adjacent pixels differ from each other, and a polarity signal is inverted when switching is performed between the first sub-frame and the second sub-frame.

According to the embodiment of the present invention, an image signal corresponding to the image to be displayed on the display means is acquired; when the first driving means and the second driving means are controlled in accordance with the acquired image signal, the first driving means is controlled in such a manner that all horizontal scanning lines of one frame are scanned by repeatedly scanning a first sub-frame in which only odd lines of horizontal scanning lines are scanned and a second sub-frame in which only even lines of horizontal scanning lines are scanned; and the second driving means is controlled in such a manner that the polarity of the first pixel of each of the pixels connected to the two corresponding signal lines differs from the polarity of the second pixel of the pixel, the polarities of the first pixels of adjacent pixels differ from each other, the polarities of the second pixels of adjacent pixels differ from each other, and a polarity signal is inverted when switching is performed between the first sub-frame and the second sub-frame.

A network is a system in which at least two devices are connected to each other and communication can be performed from one device to another device. Devices that can communicate via a network may be individual devices or internal blocks included in one device.

Moreover, as a matter of course, communication includes radio communication and wire communication, and may also include communication in which radio communication and wire communication are mixed, that is, communication in which radio communication is performed in a section and wire communication is performed in another section. Furthermore, communication in which wire communication is performed from one device to another device from which radio communication is performed to another device may be performed.

A display device may be an individual device, or a block that performs display processing in a television receiver or a recording/playback device. Moreover, a display control device may be an individual device or a block that performs display control processing in a television receiver or a recording/playback device.

According to an embodiment of the present invention, an image can be displayed. In particular, the inconsistencies in the form of streaks can be suppressed without increasing the burden due to the increase in the size of a TFT. In the case, a necessary capacity of a memory can be smaller.

BRIEF DESCRIPTION OF THE DRAWINGS

FIGS. 11A through 11C are diagrams for describing patterns of writing polarity in FIG. 10;

FIGS. 12A through 12C are diagrams for describing patterns of writing polarity in FIG. 10;

FIG. 18 is a diagram for describing a first driving example executed in the display device;

FIGS. 19A through 19D are diagrams for describing a second driving example executed in the display device;

FIGS. 20A through 20D are diagrams for describing the second driving example executed in the display device;

FIGS. 26A through 26C are diagrams for describing selected lines and inversion of a polarity signal in the case of FIG. 25;

FIGS. 30A through 30C are diagrams for describing selected lines and inversion of a polarity signal in the case of FIG. 29.

DESCRIPTION OF THE PREFERRED EMBODIMENTS

In the following, embodiments of the present invention will be described with reference to the drawings.

Figure 17:
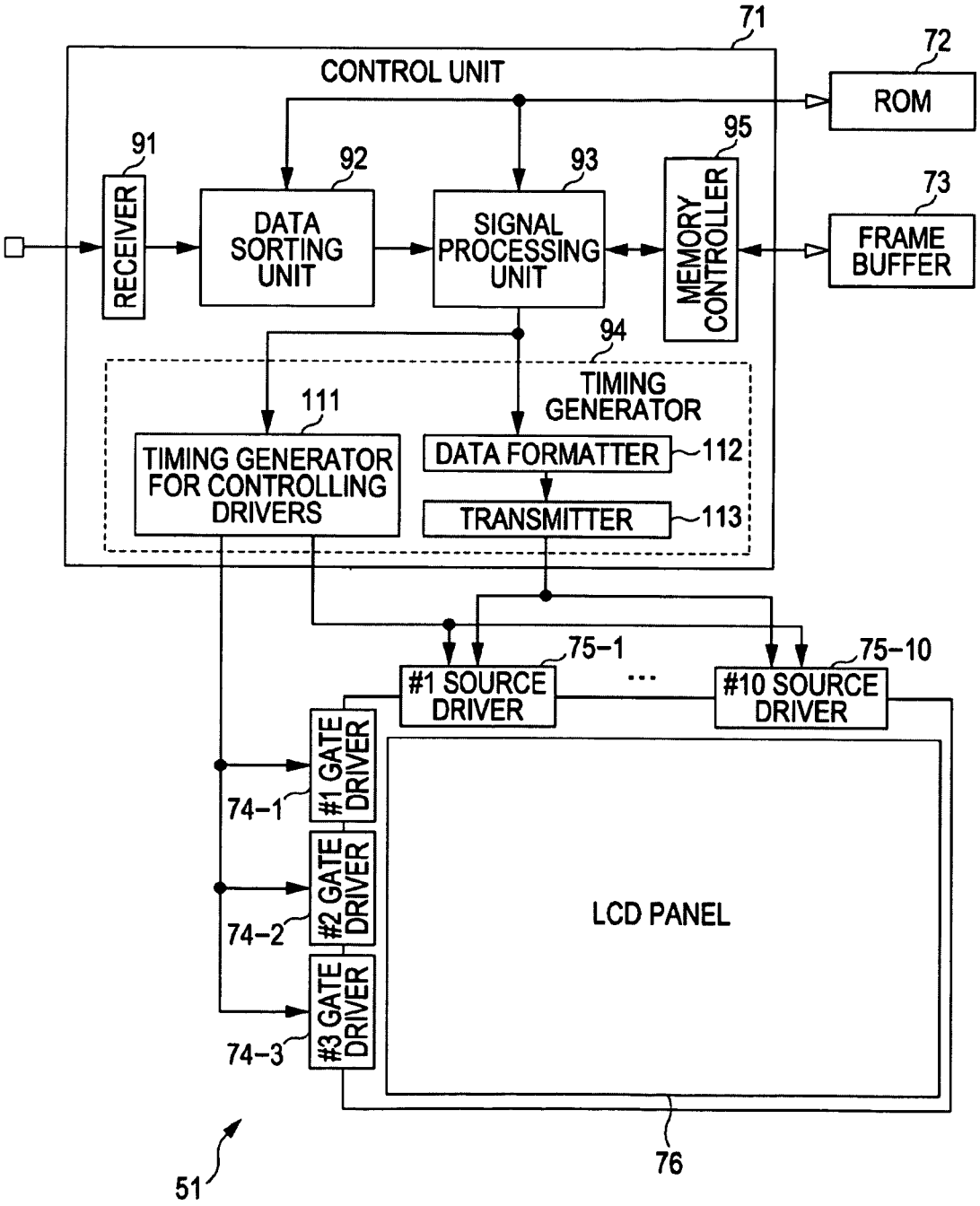
FIG. 17 is a block diagram showing the structure of a display device.

FIG. 17 is a block diagram showing the structure of a display device 51. The display device 51 includes a control unit 71, a read-only memory (ROM) 72, a frame buffer 73, a gate driver 74, a source driver 75, and a liquid crystal display (LCD) panel 76.

The control unit 71 is a unit for controlling the display device 51, and includes a receiver 91, a data sorting unit 92, a signal processing unit 93, a timing generator 94, and a memory controller 95. The control unit 71 performs signal processing (for example, color control and the like) unique to the display device 51 and also controls the gate driver 74 and the source driver 75 for driving scanning (gate) lines and data (source) lines of the LCD panel 76 in order to write image data to pixels for display.

The receiver 91 receives a video signal input from the outside, and supplies the video signal to the data sorting unit 92.

The data sorting unit 92 executes sorting of the data of an input image, and supplies the sorted input image to the signal processing unit 93.

The signal processing unit 93 refers to a parameter stored in the ROM 72, and executes gamma correction or signal processing for compensating the response of the liquid crystal and the voltage with which the operation of writing is performed to a pixel. The signal processing unit 93 supplies the processed signal to the timing generator 94 or the memory controller 95.

The timing generator 94 includes a timing generator 111 for controlling drivers, a data formatter 112, and a transmitter 113, and is a unit for performing the most basic control regarding display of the display device 51.

The timing generator 111 for controlling drivers generates a control signal for controlling the gate driver 74 for driving display elements and the source driver 75 for writing image data to pixels in accordance with the signal supplied from the signal processing unit 93, the gate driver 74 being for scanning.

The data formatter 112 converts the signal supplied from the signal processing unit 93 into a video signal whose signal format can be supplied to the source driver 75. The transmitter 113 sends the video signal converted by the data formatter 112 to the source driver 75.

The memory controller 95 controls input/output of a processed image signal to/from the frame buffer 73.

The ROM 72 stores a parameter which is necessary for the internal operation of the control unit 71 such as processing to be performed by the signal processing unit 93.

The frame buffer 73 stores image data in accordance with control performed by the memory controller 95.

A plurality of gate drivers 74 (here, three gate drivers 74-1 through 74-3) may be provided. The gate drivers 74 drive scanning (gate) lines that correspond to pixels arranged in matrix on the LCD panel 76, in accordance with control performed by the timing generator 111 for controlling drivers, and perform on/off control of active elements connected to gate bus lines.

A plurality of source drivers 75 (here, ten drivers 75-1 through 75-10) may be provided. The source drivers 75 convert, from digital to analog, the video signal supplied from the transmitter 113 into data to be written to pixels and drive corresponding source bus lines, in accordance with control performed by the timing generator 111 for controlling drivers, in such a manner that the video signal is displayed on display elements arranged in matrix on the LCD panel 76.

The LCD panel 76 includes liquid crystal display elements corresponding to the pixels arranged in matrix, and displays an image in accordance with the holding potential of the liquid crystal display elements.

The operation of the display device 51 will be described.

First, the receiver 91 of the control unit 71 receives a video signal, and supplies the video signal to the data sorting unit 92. The data sorting unit 92 sorts the data of the video signal and supplies the sorted video signal to the signal processing unit 93 in accordance with the setting recorded in the ROM 72, in such a manner that display can be performed, for example, as described in the following description using FIGS. 18 through 30.

Then, the signal processing unit 93 performs one-to-one correction regarding RGB γ using a parameter recorded in the ROM 72, and supplies the resulting signal to the frame buffer 73 via the memory controller 95. The signal processing unit 93 reads an image signal which is delayed by one frame from the frame buffer 73 via the memory controller 95 and executes signal processing for compensating the response of the liquid crystal of the LCD panel 76 and the voltage with which the operation of writing is performed to a pixel, by performing comparison operation between the read image signal and an image signal of the next frame. The signal processing unit 93 supplies the processed signal to the timing generator 94.

The timing generator 111 for controlling drivers and data formatter 112 of the timing generator 94 receive the processed signal from the signal processing unit 93. The timing generator 111 for controlling drivers generates a control signal for controlling the gate drivers 74 and the source drivers 75 for driving display elements of the LCD panel 76, and outputs the control signal to the gate drivers 74 and the source drivers 75.

Then, the data formatter 112 converts the signal supplied from the signal processing unit 93 into a video signal whose signal format can be supplied to the source drivers, and supplies the video signal to the transmitter 113. The transmitter 113 sends the video signal converted by the data formatter 112 to the source drivers.

The source drivers 75 convert, from digital to analog, the video signal supplied from the transmitter 113 into data to be written to pixels and drive corresponding source bus lines to display the video signal on display elements arranged in matrix on the LCD panel 76 in accordance with control performed by the timing generator 111 for controlling drivers, whereby the LCD panel 76 displays an image. Here, the timing generator 111 for controlling drivers controls the timing at which a polarity signal POL is inverted, the polarity signal POL being used to determine the output characteristics of the source drivers 75. The inversion of the polarity signal POL and the writing polarities for pixels will be specifically described below.

A first driving example executed in the display device 51 will be described with reference to FIG. 18.

One frame is divided into two sub-frames 1/2 and 2/2. The polarity of the source bus lines is not inverted in each of the sub-frames. The polarity of the source bus lines is inverted between the sub-frames. Furthermore, the gates of every other line are selected in units of one sub-frame. That is, one frame is divided into an odd sub-frame in which only odd lines are selected and an even sub-frame in which only even lines are selected.

In this case, the number of times the polarity inversion is performed increases to two times/frame, compared with existing vertical line inversion driving whose number of times the polarity inversion is performed is one time/frame. However, the number of times the polarity inversion is performed in this case is much less than that of dot-inversion driving (that is, the number of times the polarity inversion is performed is determined by the number of lines, and thus, for example, the number of times the polarity inversion is performed is 1080 in the case of full high-definition TV). Thus, the power consumption merely slightly increases.

The right side of FIG. 18 shows the polarity arrangement in units of one frame. In contrast to existing vertical line inversion driving in which positive polarities or negative polarities are continuously arranged in each vertical column on every occasion, if this proposed scheme is used, the polarity arrangement is equivalent to that of dot inversion driving at least during half a period of one frame, whereby a problem of flicker or inconsistencies in the form of vertical streaks in a moving image can be greatly reduced.

Next, as a second driving example executed in the display device 51, a case in which the LCD panel 76 having a multi-pixel structure is driven will be described.

Figure 1:
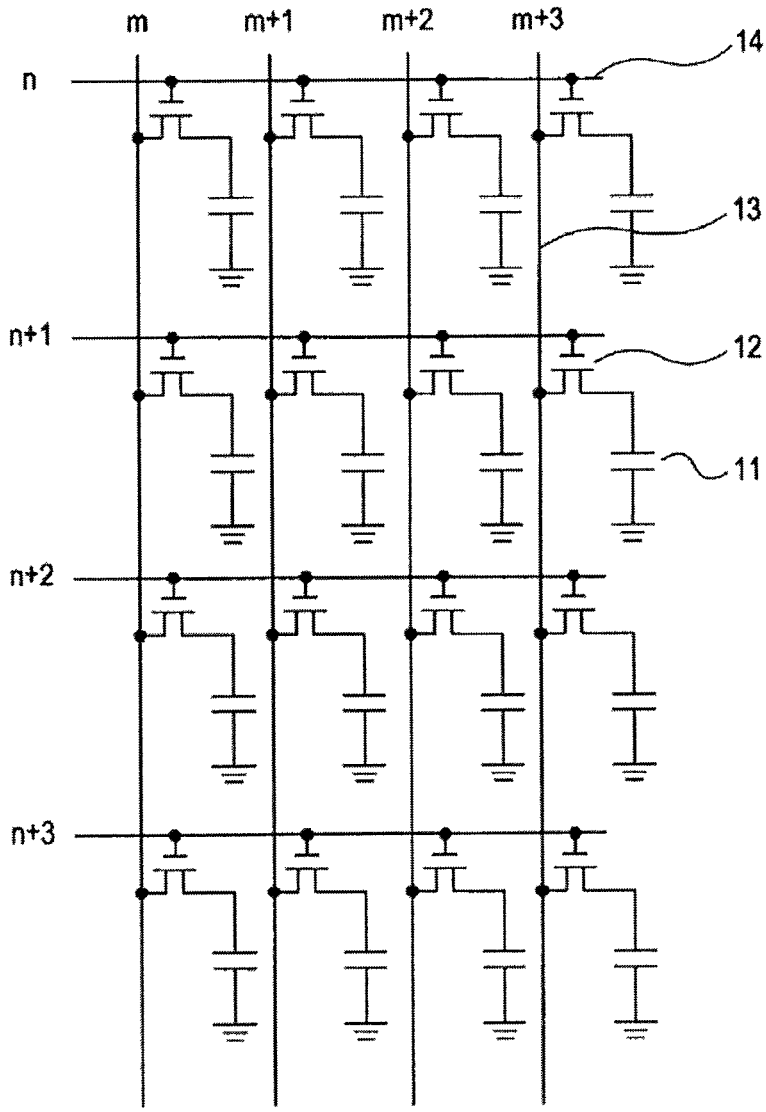
FIG. 1 PRIOR ART
FIG. 1 is a diagram for describing an active matrix of a liquid crystal display panel.
Figure 2:
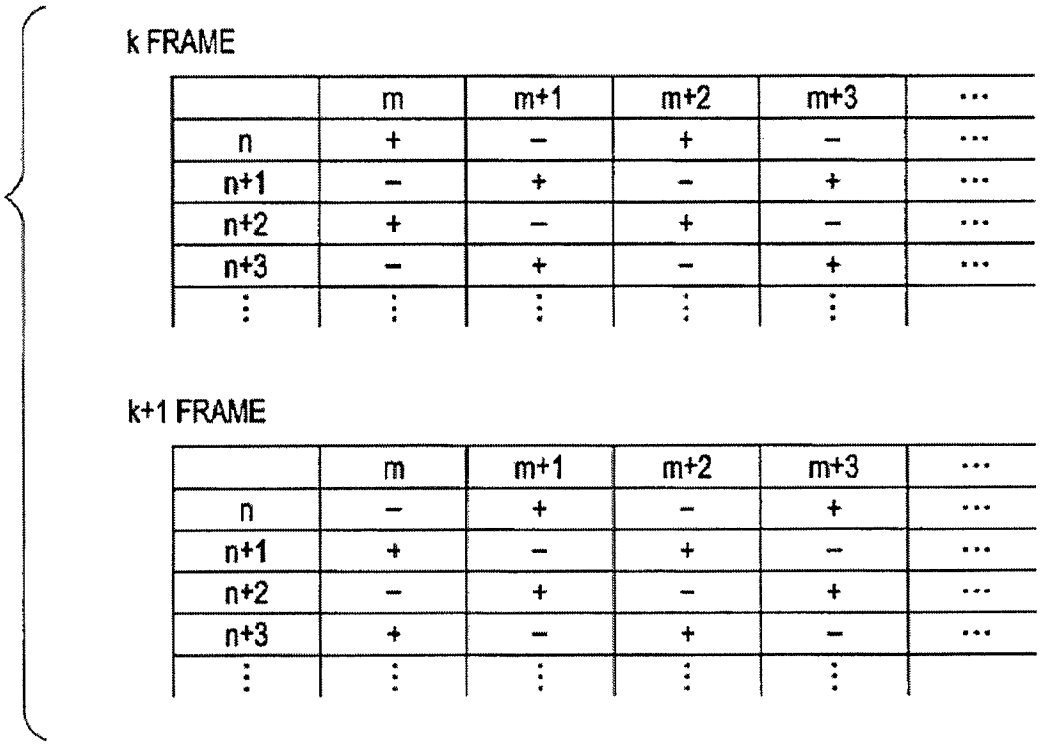
FIG. 2 PRIOR ART
FIG. 2 is a diagram for describing patterns of the polarity arrangement of pixels in a case where liquid crystal is driven.
Figure 3:
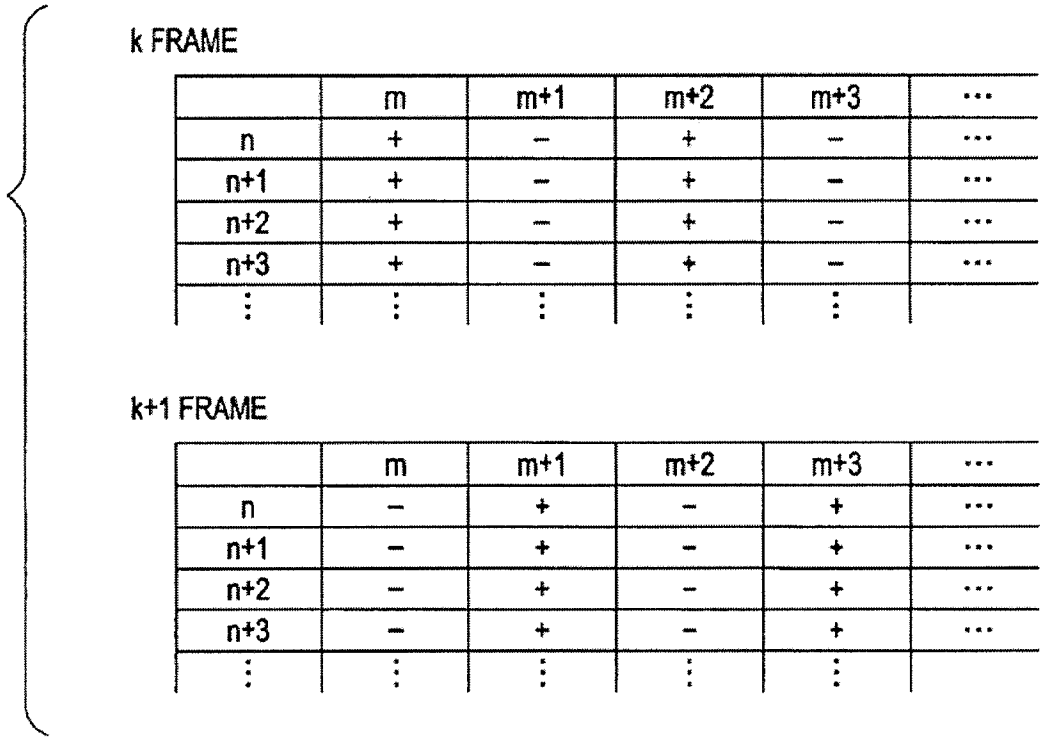
FIG. 3 PRIOR ART
FIG. 3 is a diagram for describing patterns of the polarity arrangement of pixels in a case where liquid crystal is driven.
Figure 4:
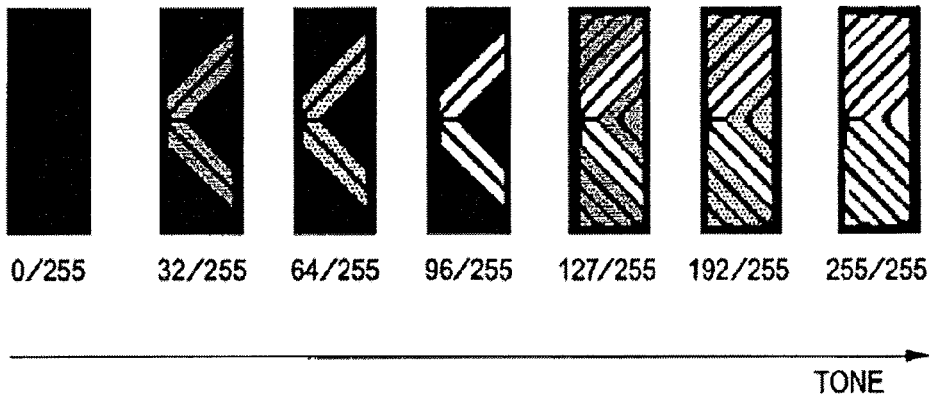
FIG. 4 PRIOR ART
FIG. 4 is a diagram for describing a multi-pixel structure used for achieving a wide viewing angle.
Figure 5A:
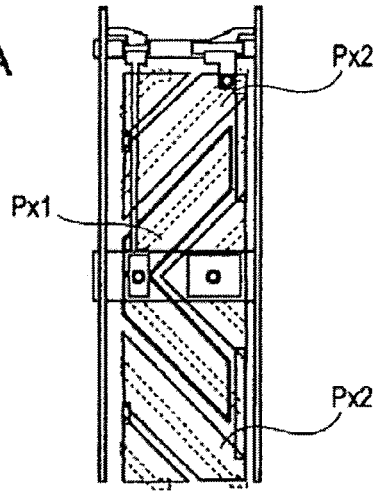
FIGS. 5A through 5C are diagrams for describing a multi-pixel structure used for achieving a wide viewing angle.
Figure 5B:
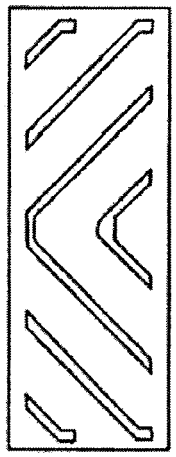
Figure 5C:
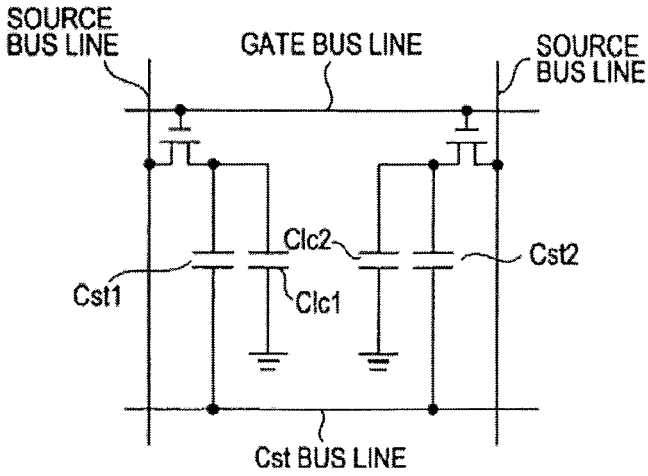
Figure 6:
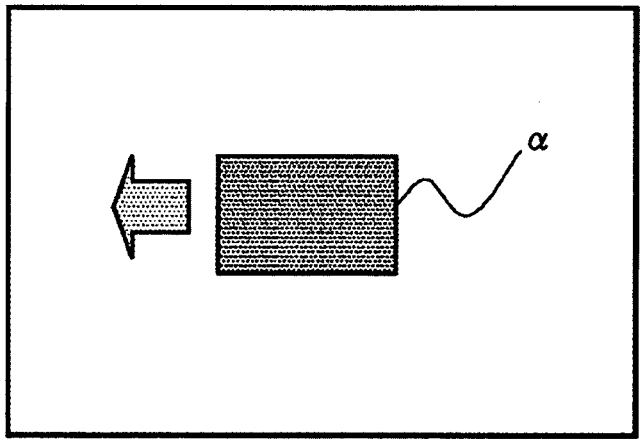
FIG. 6 is a diagram for describing the occurrence of inconsistencies in the form of vertical streaks when vertical line inversion is performed.
Figure 7:
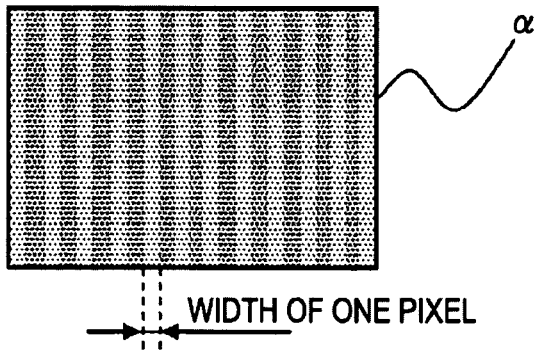
FIG. 7 is a diagram for describing the occurrence of inconsistencies in the form of vertical streaks when vertical line inversion is performed.
Figure 8:
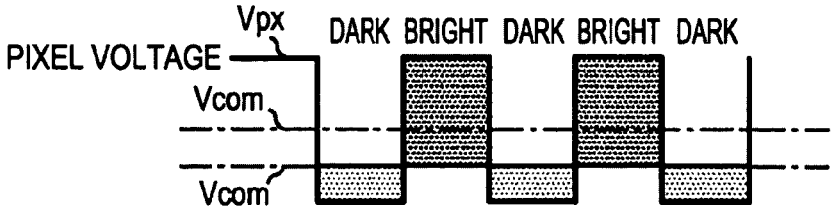
FIG. 8 is a diagram for describing the occurrence of inconsistencies in the form of vertical streaks when vertical line inversion is performed.
Figure 9A:
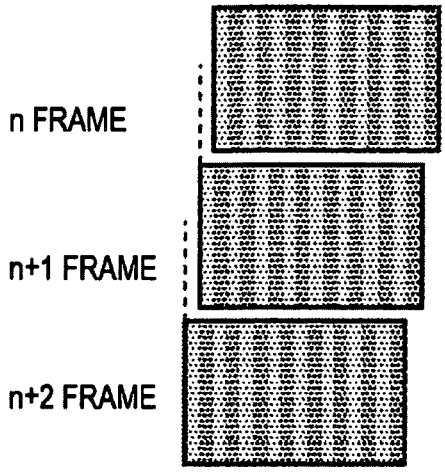
FIGS. 9A and 9B are diagrams for describing the occurrence of inconsistencies in the form of vertical streaks when vertical line inversion is performed.
Figure 9B:
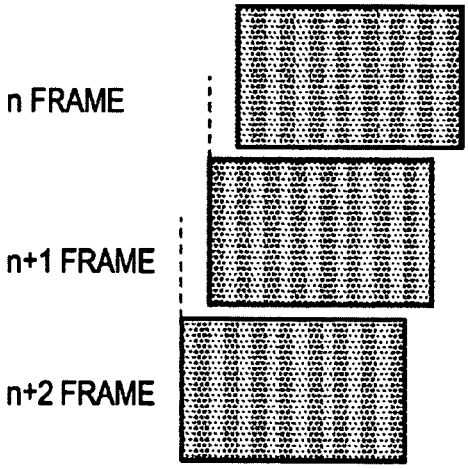
Figure 10:
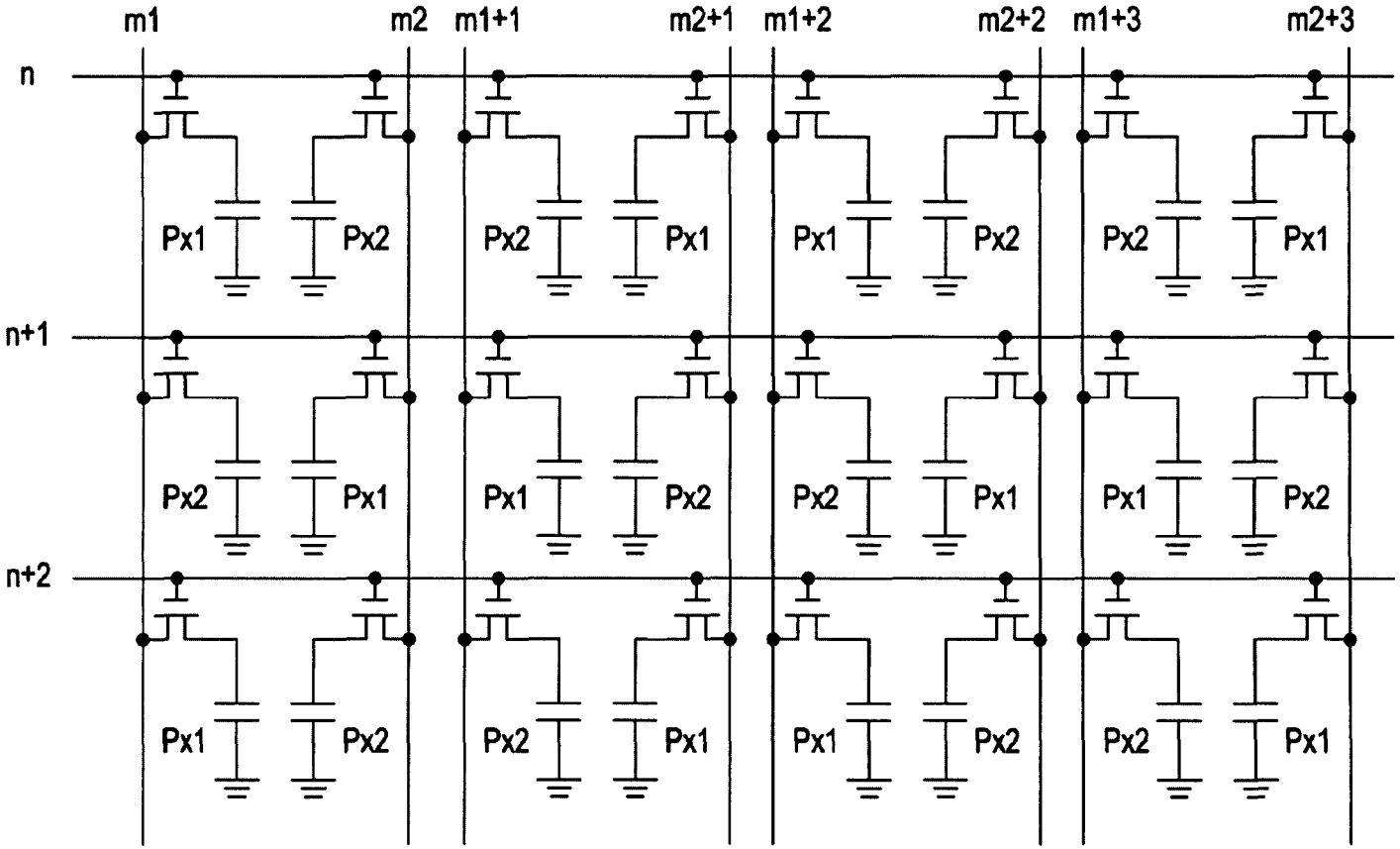
FIG. 10 is a diagram for describing the arrangement of pixels for solving a problem of the occurrence of inconsistencies in the form of vertical streaks.
Figure 13A:
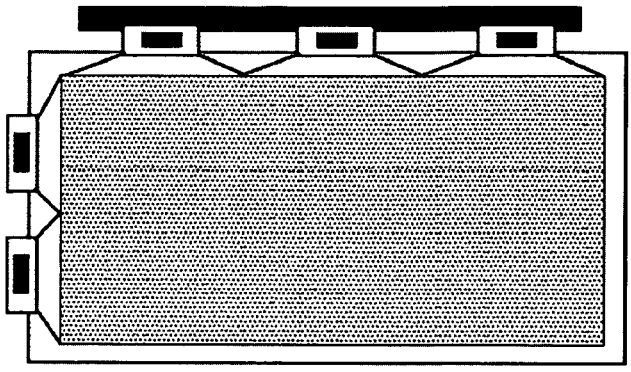
FIGS. 13A and 13B are diagrams for describing the occurrence of inconsistencies in the form of streaks at low temperatures.
Figure 13B:
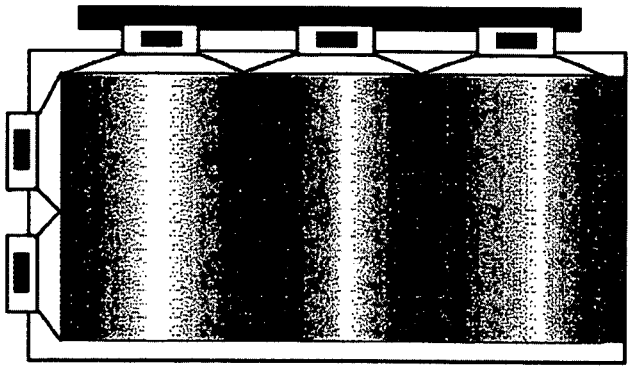
Figure 14A:
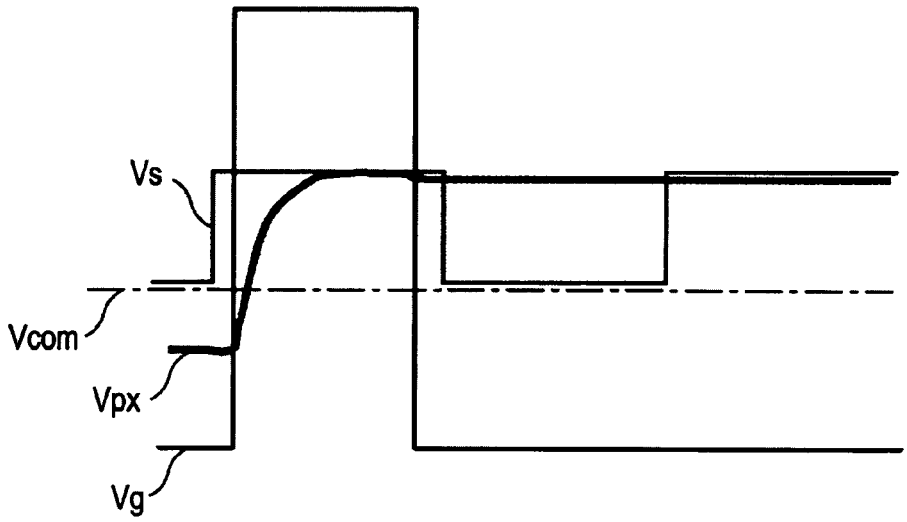
FIGS. 14A and 14B are diagrams for describing the occurrence of inconsistencies in the form of streaks at low temperatures.
Figure 14B:
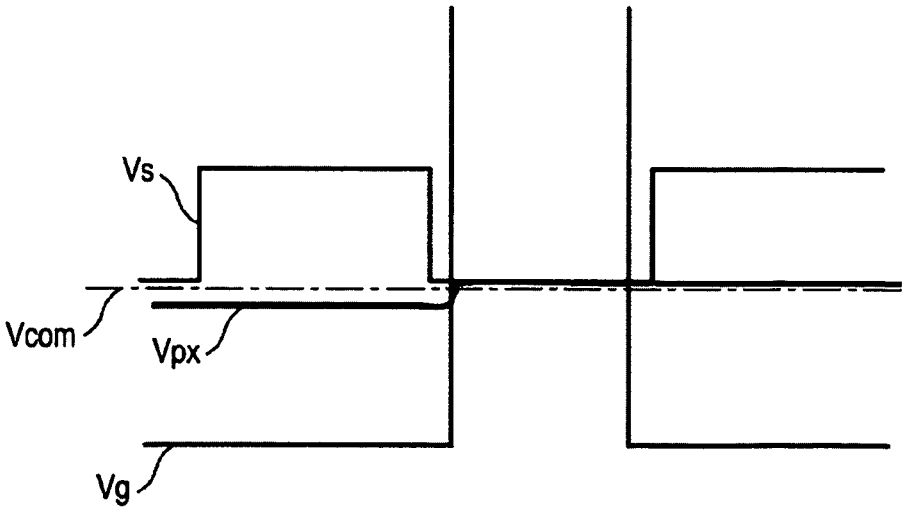
Figure 15A:
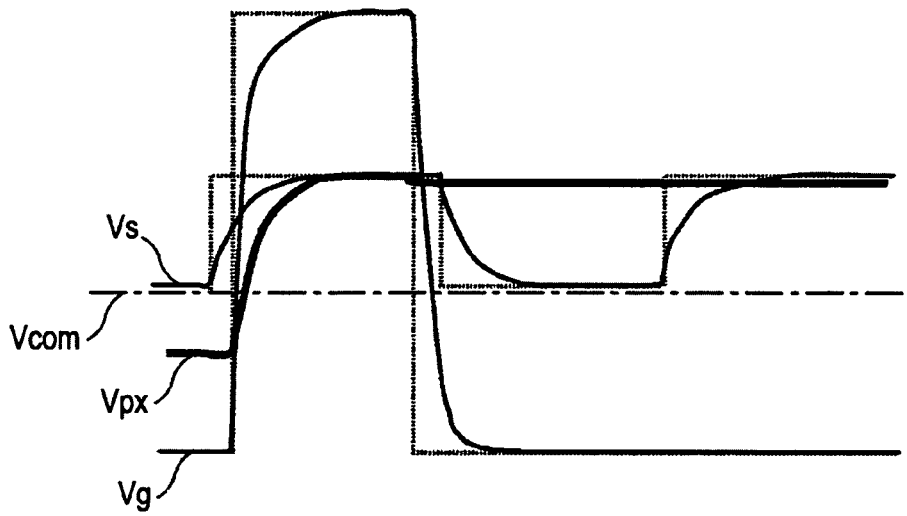
FIGS. 15A and 15B are diagrams for describing the occurrence of inconsistencies in the form of streaks at low temperatures.
Figure 15B:
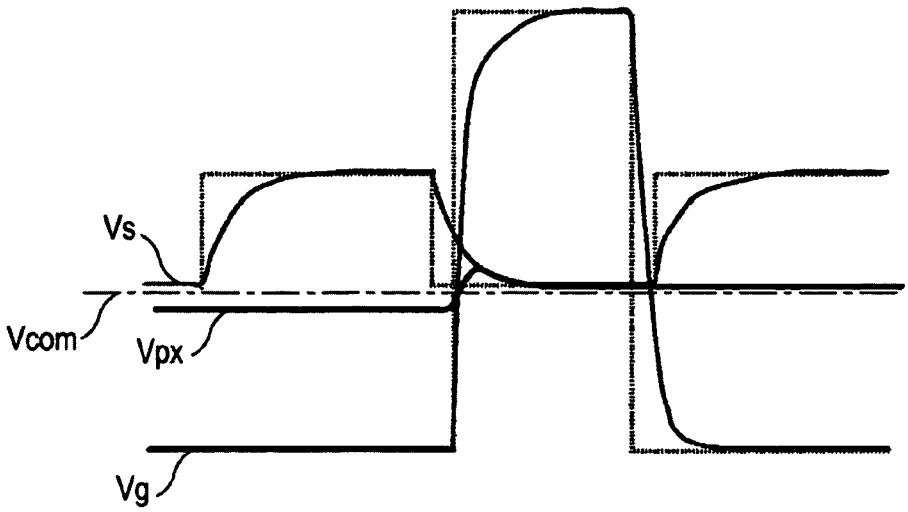
Figure 16A:
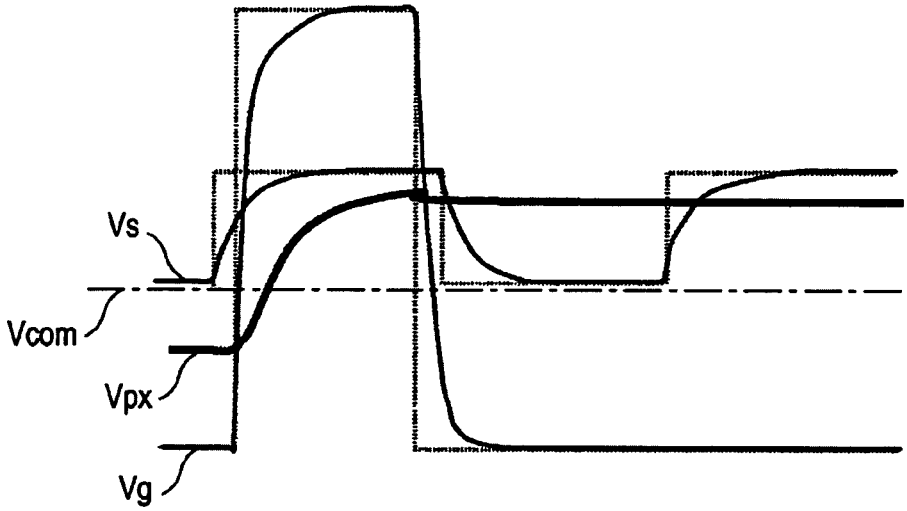
FIGS. 16A and 16B are diagrams for describing the occurrence of inconsistencies in the form of streaks at low temperatures.
Figure 16B:
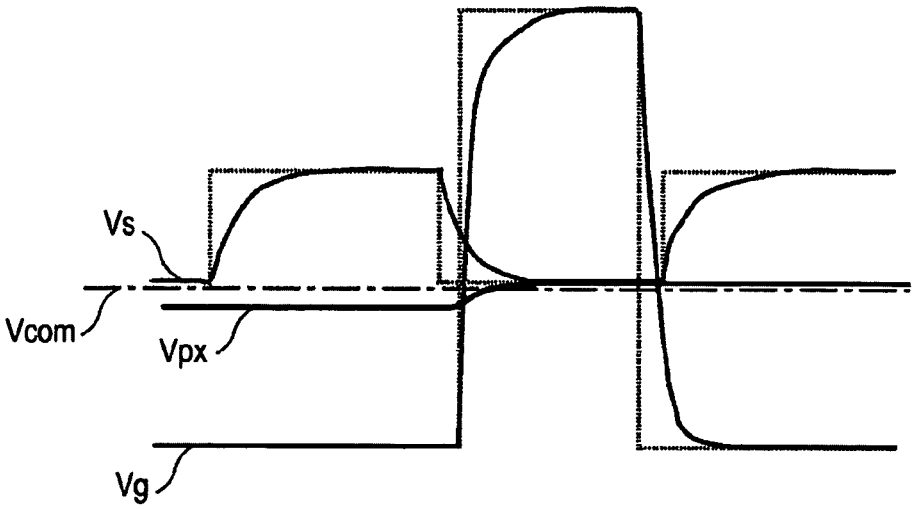

In the display device 51, for example, the LCD panel 76 having a multi-pixel structure described using FIGS. 4, 5, and 10 can also be driven. That is, each of the pixels can be divided into a plurality of pixels (here, two pixels of a sub-pixel A and a sub-pixel B). Regarding an input tone, the pixel is configured in such a manner that the brightness of the sub-pixel A first increases and then the brightness of the sub-pixel B increases, and thus the entire brightness is adjusted so as to satisfy a gamma characteristic. There are a plurality of ways to differentiate the electric potential of the sub-pixel A from the electric potential of the sub-pixel B. For example, as described using FIG. 5A, a dedicated TFT is provided for each sub-pixel and, as shown in the equivalent circuit as described using FIG. 5C, two source bus lines are provided for the same gate bus line using the pattern of a counter electrode ITO as described using FIG. 5B and the TFTs for the sub-pixels A and B can individually be driven.

Then, the pixel arrangement of the LCD panel 76 is the same as that described using FIG. 10. That is, the pixel electrode for the sub-pixel A is denoted by Px1, and the pixel electrode for the sub-pixel B is denoted by Px2. The TFT for driving the pixel electrode Px1 is denoted by TFT1, and the TFT for driving the pixel electrode Px2 is denoted by TFT2. The pixel electrodes Px1 and Px2 each have a dedicated TFT. The pixel electrodes Px1 and Px2 are connected to right and left source bus lines in a checkerboard manner. Thus, for each source bus line, the pixel electrodes Px1 and Px2 are alternately connected such as Px1, Px2, Px1, Px2, and so on.

Even in a case of driving such pixels having a multi-pixel structure, in the display device 51, one frame is divided into sub-frames 1/2 and 2/2. The polarity of the source bus lines is not inverted in each of the sub-frames and the polarity of the source bus lines is inverted between the sub-frames. Moreover, the gates of every other line are selected in units of one sub-frame. That is, even in this case, one frame is divided into an odd sub-frame in which only odd lines are selected and an even sub-frame in which only even lines are selected. In this case, the polarity arrangement in the k-th frame is shown in FIG. 19 and the polarity arrangement in the k+1-th frame is shown in FIG. 20.

Here, bold pluses (+) and bold minuses (−) indicate the pixel electrodes Px1 and regular pluses (+) and regular minuses (−) indicate the pixel electrodes Px2. More specifically, in the k(1/2)-th frame shown in FIG. 19A, vertical lines of m1, m2+1, m1+2, and m2+3 correspond to the pixel electrodes Px1 and others correspond to the pixel electrodes Px2. In the k(2/2)-th frame shown in FIG. 19B, inversion occurs from the k(1/2)-th frame, and vertical lines of m2, m1+1, m2+2, and m1+3 correspond to the pixel electrodes Px1 and others correspond to the pixel electrodes Px2.

That is, in the polarity arrangement shown in FIGS. 19A through 20D, the polarity is different between m1 and m2 and between m1+β and m2+β (β is an integer greater than or equal to 1). The polarity is the same between m1 and m1+1, between m2 and m2+1, between m1+β and m1+(β+1), and between m2+β and m2+(β+1) (β is an integer greater than or equal to 1).

In such a case, even when only odd lines are driven or only even lines are driven, each source bus line only drives either the pixel electrode Px1 or the pixel electrode Px2. Then, as shown in FIGS. 19C and 19D and FIGS. 20C and 20D, the pixel electrodes Px1 have a polarity arrangement equivalent to that of dot inversion driving and the pixel electrodes Px2 also have a polarity arrangement equivalent to that of dot inversion driving. That is, in the display device 51, when such driving is performed, a problem of flicker and inconsistencies in the form of vertical streaks in a moving image can be greatly reduced by the polarity arrangement obtained in a state in which driving of two sub-frames is finished.

When a halftone is displayed using pixels having a multi-pixel structure, in the related art, the voltage of source bus lines greatly changes, whereby the power consumption becomes large; however, as described using FIGS. 19A through 20D, in the display device 51, the operation of writing is performed using a group of pixel electrodes Px1 or a group of pixel electrodes Px2 in units of a sub-frame. Thus, the change in voltage can be suppressed, whereby the power consumption can be prevented from becoming large. For example, in the case of uniform tone display over the entire display, no matter which tone is displayed, electric current flows the source bus lines for a moment when switching is performed between sub-frames and this happens only two times in one frame in such a case. In this way, in the display device 51, even when a halftone is displayed using pixels having a multi-pixel structure, the effects of vertical frame inversion can be utilized to the utmost.

Figure 21A:
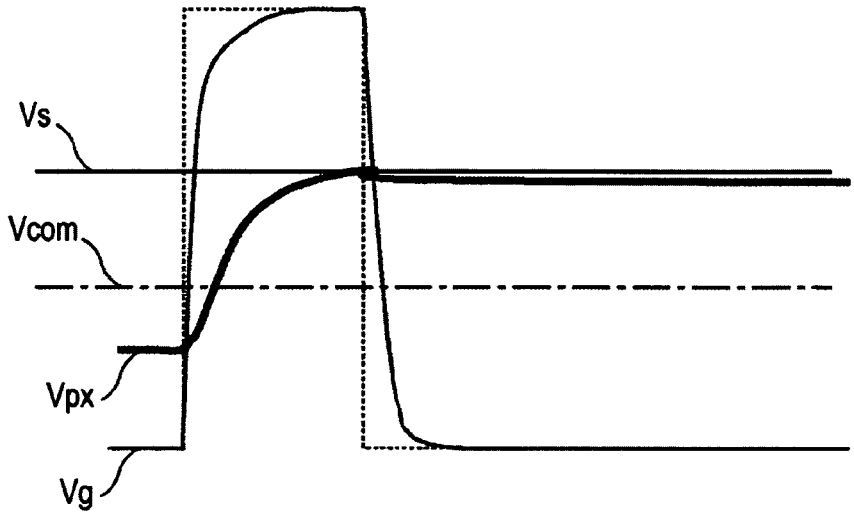
FIGS. 21A and 21B are diagrams for describing voltages applied to a TFT in the second driving example.
Figure 21B:
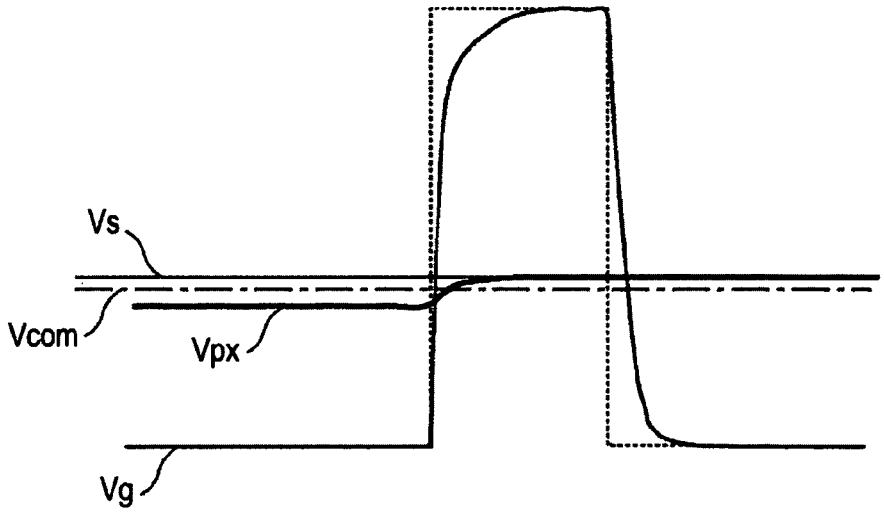

Next, FIG. 21 shows voltages applied to a TFT in the display device 51. In FIG. 21, the central electric potential Vcom of the common voltage, the voltage Vg of a gate bus line, the voltage Vs of a source bus line, and the voltage Vpx of a pixel electrode.

As shown in FIG. 21, the change in the voltage Vs of a source bus line is small, even when the performance of the TFT lowers, the operation of writing data within a period is easily performed. Thus, as its effect, a safety margin of TFT performance can be obtained. As a result, the inconsistencies occurring at low temperatures can be decreased without increasing the burden due to the increase in the size of the TFT.

As described above, two sub-frames 1/2 and 2/2 are designed to drive only odd lines and only even lines, respectively. That is, in the display device 51, even in the case of pixels having a multi-pixel structure or even in the case of pixels having a general structure, for example, as shown in FIG. 22, driving is performed in such a manner that only the odd lines are first selected from the top of the screen and driven, and then only the even lines are selected from the top of the screen and driven.

Figure 23A:
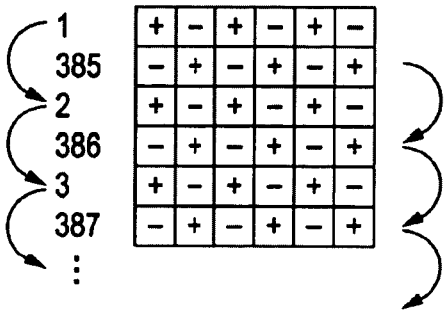
FIGS. 23A and 23B are diagrams for describing selected lines and inversion of a polarity signal in the case of FIG. 22.

Here, as shown in FIG. 23A, after the first line is driven, the third line is driven and then the fifth line is driven. After all the odd lines are driven, the second line, the fourth line, and so on are driven (the numbers in FIG. 23A indicate the driving order of the lines). Thus, as shown in FIG. 23B, the polarity signal POL changes once every time switching is performed between sub-frames (the numbers in FIG. 23B indicate the line number counted from the top of the screen).

Figure 22:
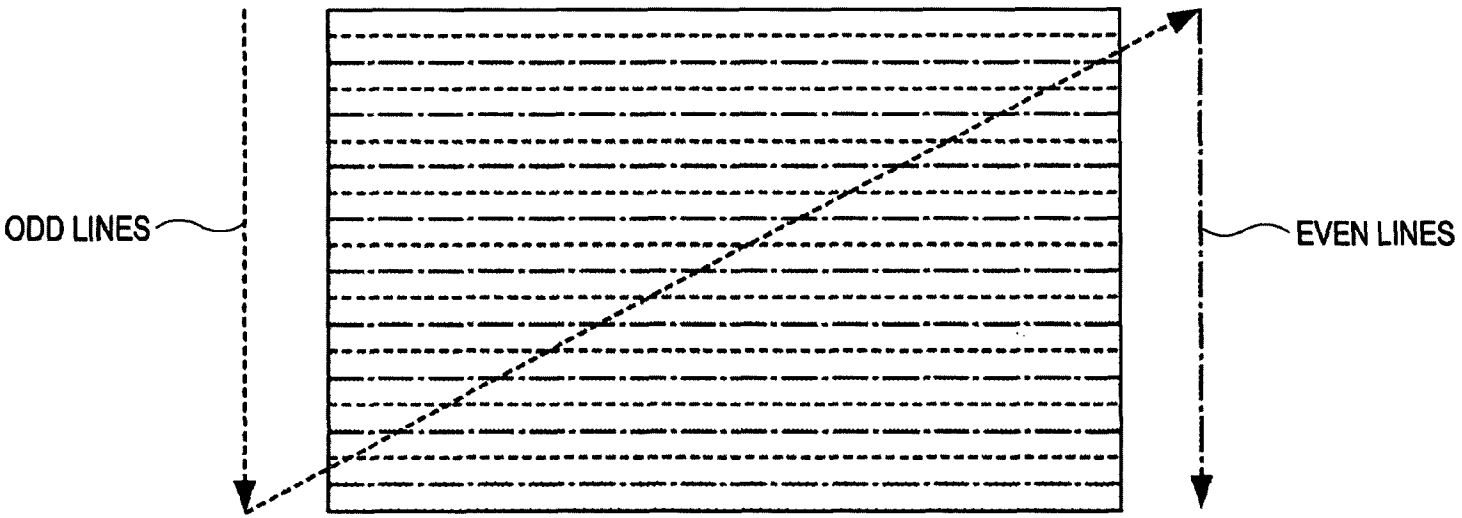
FIG. 22 is a diagram for describing sub-frames.
Figure 23B:
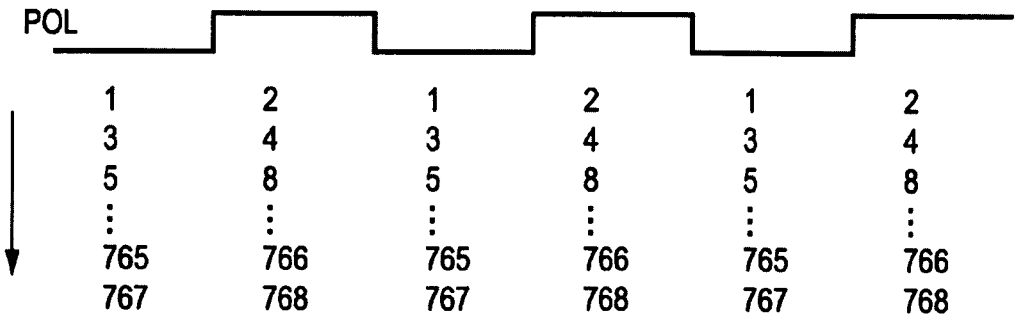
Figure 24:
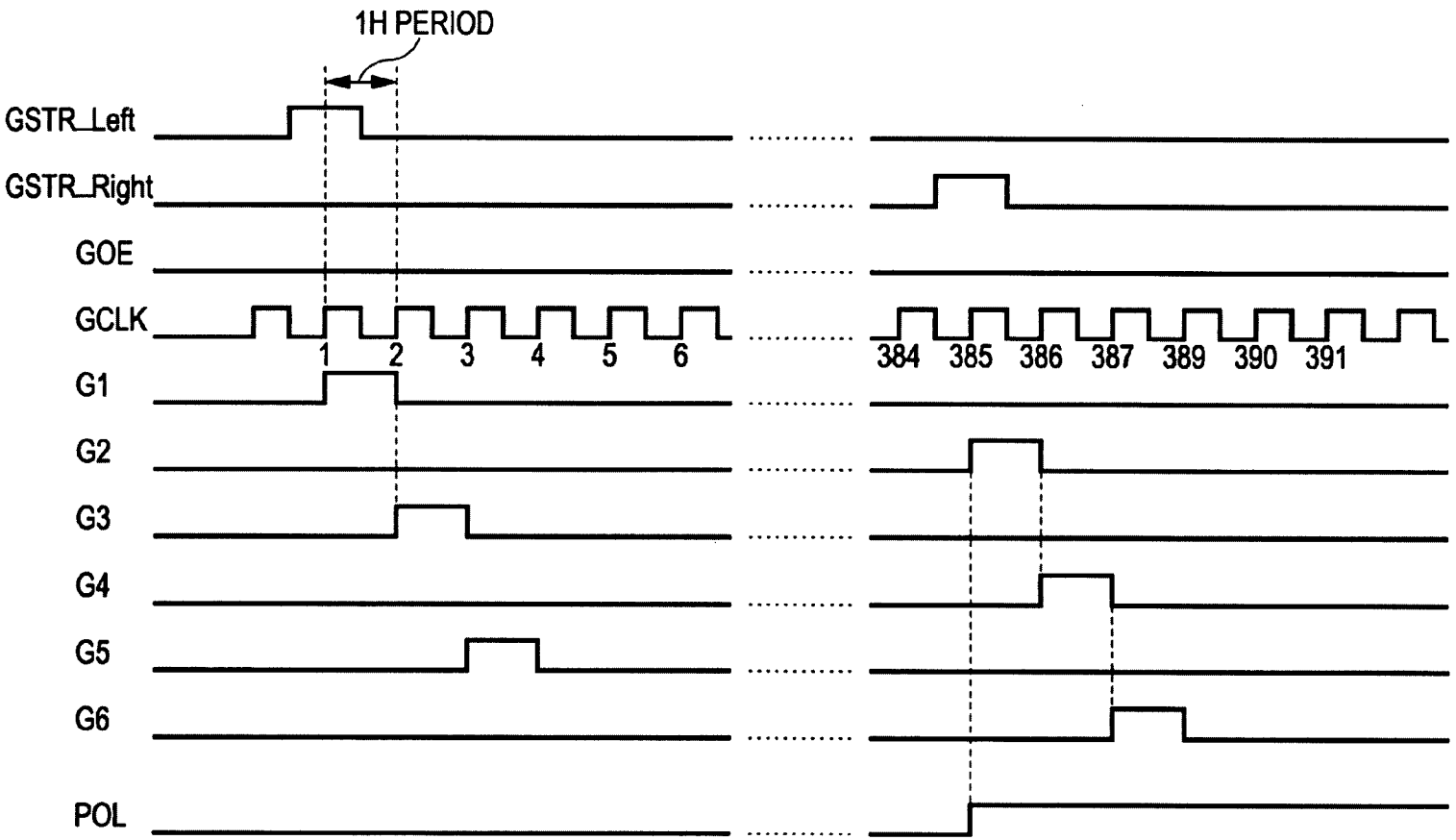
FIG. 24 is a diagram for describing driving signals in the case of FIG. 22.

FIG. 24 shows driving signals for operating the LCD panel 76 in the case described using FIGS. 22 through 23B. In FIG. 24, GSTR_Left denotes a signal indicating the start of scanning odd lines, GSTR_Right denotes a signal indicating the start of scanning even lines, CGLK denotes a reference clock signal for horizontal synchronization, G1, G2, and so on each denote a gate-driving waveform of a corresponding line, and POL denotes a signal for controlling the driving polarity for source drivers.

In this way, in the case described using FIGS. 22 through 23B, driving is performed in such a manner that after only the odd lines are selected from the top of the screen, only the even lines are selected from the top of the screen.

In contrast, one screen may be divided into a plurality of frames, and each of the frames may further be divided into two sub-frames 1/2 and 2/2 as described above.

Figure 25:
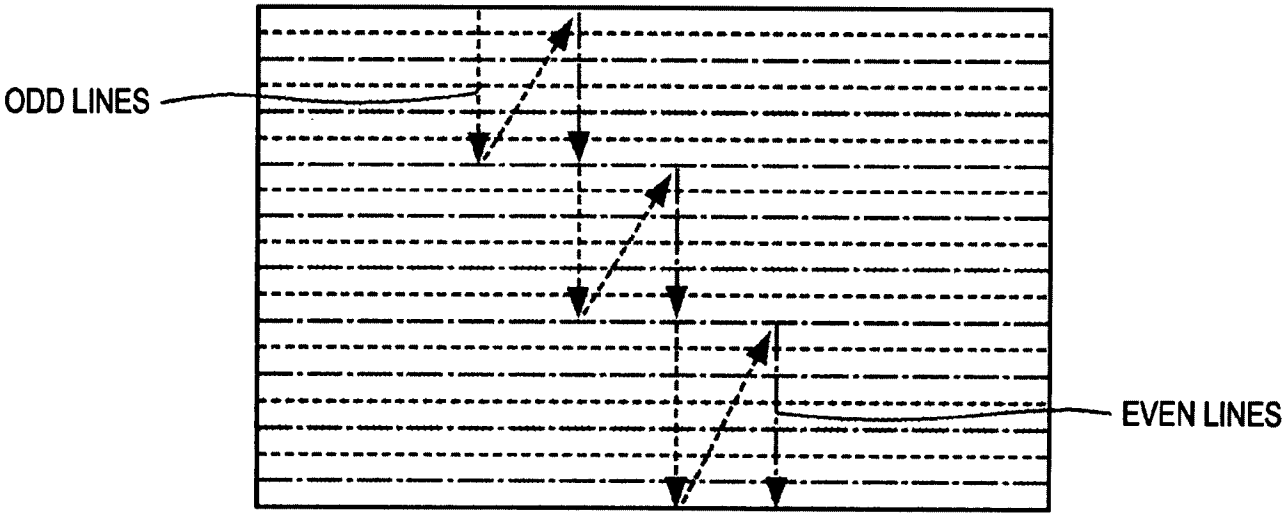
FIG. 25 is a diagram for describing sub-frames when a frame is divided.

That is, as described using FIGS. 22 through 24, in order to divide one frame into two sub-frames 1/2 and 2/2 for driving only the odd lines and only the even lines, a frame memory of at least the capacity of storing one screen is necessary for storing an input signal. Thus, in the display device 51, as shown in FIG. 25, even in the case of pixels having a multi-pixel structure or even in the case of pixels having a general structure, one screen is divided into some areas, and odd and even sub-frames are switched therebetween several times within one frame. As the number of areas into which one screen is divided increases, a necessary capacity of a memory becomes smaller; however, the number of times the polarity inversion is performed increases and thus the power consumption increases. If the inversion is performed every line, it is the same as dot inversion driving and the power consumption is high; however, for example, if the inversion is performed every two lines, a power-consumption reducing effect can be obtained, compared with dot inversion driving.

For example, as shown in FIG. 26A, when one screen is divided into twelve areas along the horizontal direction, as shown in FIG. 26B, after the first line is driven, the third line is driven and then the fifth line is driven. After 32 odd lines to the 63rd line are driven, the second line, the fourth line, and so on are driven (the numbers in FIG. 26B indicate the driving order of the lines). Thus, as shown in FIG. 26C, the polarity signal POL changes 24 times within one frame, that is, the polarity signal POL changes once every time switching is performed between sub-frames in the frame that is divided into twelve areas (the numbers in FIG. 26C indicate the line number counted from the top of the screen).

Figure 27:
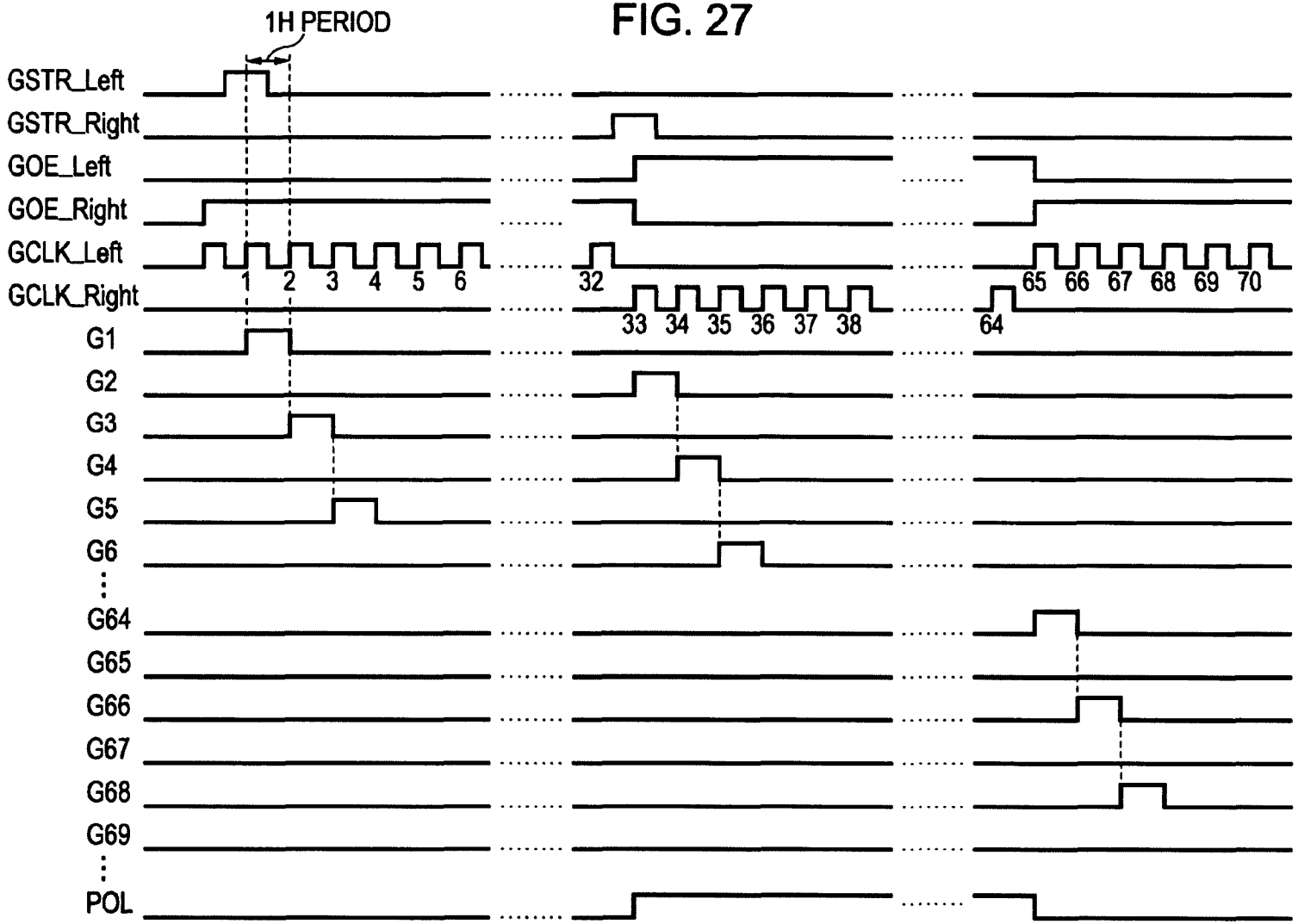
FIG. 27 is a diagram for describing driving signals in the case of FIG. 25.

FIG. 27 shows driving signals for operating the LCD panel 76 in the case described using FIGS. 26A through 26C. In FIG. 27, GSTR_Left denotes a signal indicating the start of scanning odd lines, GSTR_Right denotes a signal indicating the start of scanning even lines, CGLK_Left denotes a reference clock signal for horizontal synchronization for odd lines, and CGLK_Right denotes a reference clock signal for horizontal synchronization for even lines. Here, as a matter of course, a reference clock signal may be a single signal as in the case described using FIG. 24. Moreover, G1, G2, and so on each denote a gate-driving waveform of a corresponding line, and POL denotes a signal for controlling the driving polarity for source drivers.

In this way, in the case described using FIGS. 26A through 27, switching is performed between the sub-frames in the frame that is divided into twelve areas, and odd lines or even lines are driven in each sub-frame, whereby the power consumption can be suppressed and a necessary capacity of a memory can be smaller, compared with dot inversion driving.

Figure 28:
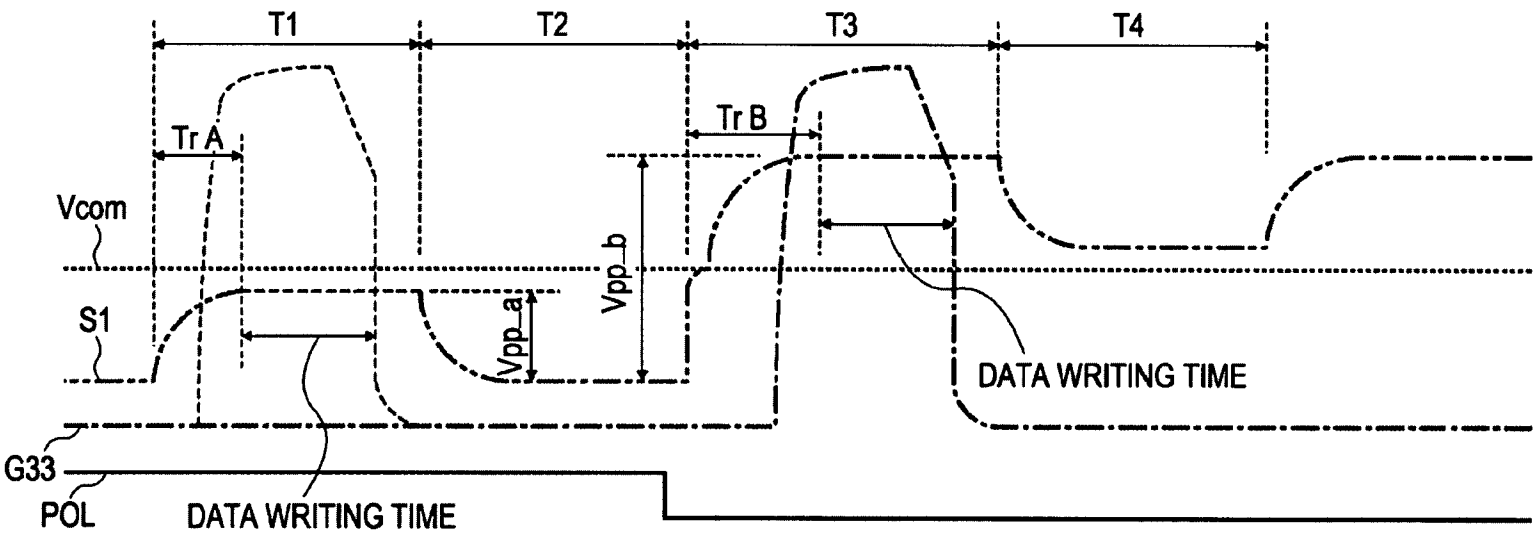
FIG. 28 is a diagram for describing driving waveforms in the case of FIG. 25.

FIG. 28 shows driving waveforms that operate each pixel of the LCD panel 76 in the driving method described using FIGS. 26A through 27.

In FIG. 28, VCOM denotes the electric potential of the counter electrode regarding the electric potential of each of the pixels of the LCD panel 76. The display potential is determined by the capacitance determined by the counter electrode and the pixel. Then, S1 denotes a driving waveform of a source bus line, and G33 denotes a driving waveform of the 33rd scanning (gate) line, and POL denotes a signal for controlling the driving polarity for the source drivers 75.

While the first through 31st odd lines are being driven, that is, while the polarity signal POL is fixed, the source drivers 75 do not cause any change that crosses the electric potential VCOM and thus a rising time can be short. However, next, when the 33rd gate line is driven, that is, when odd-line driving is switched to even-line driving and when the polarity signal POL is inverted and the driving waveform G33 becomes high, a time period necessary for the electric potential of the source driver to become a desired level is longer than a fixed time period necessary for the electric potential of the source drivers to become a desired level in a state in which the polarity signal POL is fixed (Tr_B>Tr_A). Thus, for example, if Tr_B=Tr_A is set, a sufficient time period for performing an operation of writing is not obtained. Thus, as shown in FIG. 28, by setting the time period for performing an operation of writing at the 33rd gate line to be longer than other time periods for performing the operation of writing at other lines, conditions of the operation of writing are balanced. That is, it is preferable that the timings in FIG. 28 are set in such a manner that T3>T1 and T1=T2=T4.

By performing setting in this way, a sufficient time period for performing the operation of writing can be obtained when the signal POL is inverted, and thus the occurrence of inconsistencies at this portion can be prevented.

Moreover, similarly, at other timings when odd-line driving is switched to even-line driving and when even-line driving is switched to odd-line driving, as a matter of course, the time period for performing the operation of writing at the first line after switching is performed should be set longer than other time periods for performing the operation of writing at other lines.

Then, furthermore, when one screen is divided into a plurality of frames, each frame may be divided into two sub-frames 1/2 and 2/2 in such a manner that an area in which odd lines are scanned and an area in which even lines are scanned do not match.

Figure 29:
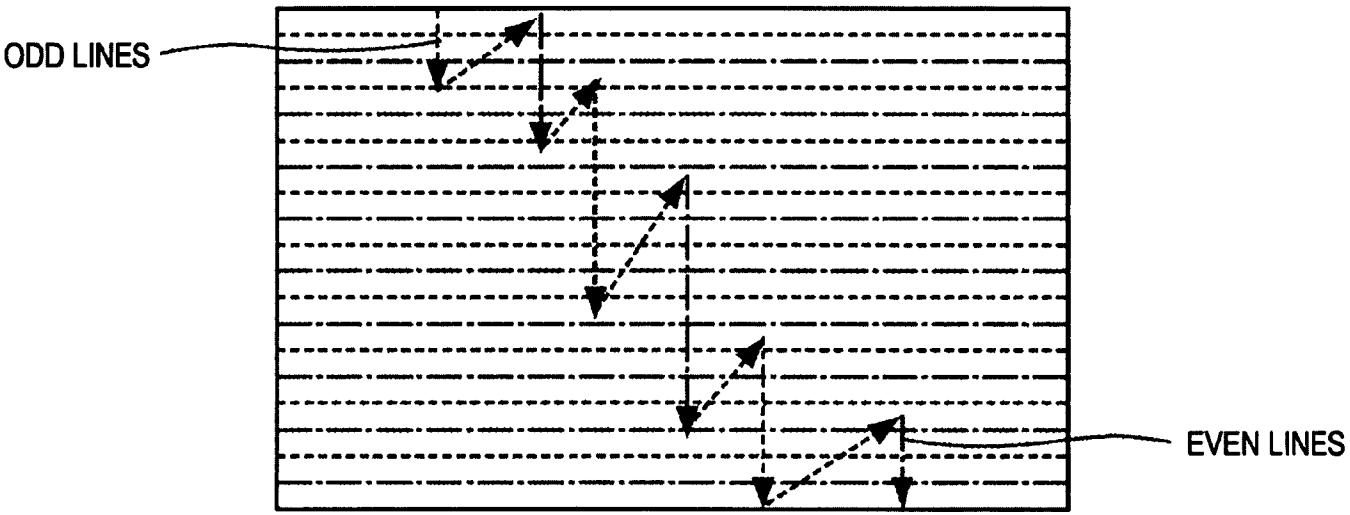
FIG. 29 is a diagram for describing sub-frames in a case where frame division for odd lines is different from frame division for even lines.

That is, as shown in FIG. 29, in the display device 51, even in the case of pixels having a multi-pixel structure or even in the case of pixels having a general structure, the position of each of the selected lines is made to be different between subsequent odd and even sub-frames and switching is performed between these sub-frames a plurality of times within one frame. In other words, in the display device 51, even in the case of pixels having a multi-pixel structure or even in the case of pixels having a general structure, the position at which the polarity signal POL changes can be set for each sub-frame in such a manner that the position for the sub-frame does not overlap the position for another sub-frame. The number of the selected lines in an odd sub-frame and the number of selected lines in an even sub-frame may be randomly set; however, for ease of control, they may be set in a predetermined regulated manner. Here, also, as the number of areas obtained as a result of division increase, a necessary capacity of a memory becomes smaller; however, the number of times the polarity inversion is performed increases and thus the power consumption increases. However, for example, if inversion is performed every two or more lines, a power-consumption reducing effect can be obtained, compared with dot inversion driving.

For example, as shown in FIG. 30A, when one screen is divided into twelve areas along the horizontal direction and the number of lines selected in the first odd sub-frame is half the number of the lines of one of the areas, as shown in FIG. 30B, after the first line is driven, the third line is driven and then the fifth line is driven. After 16 odd lines to the 31st line are driven, the second line, the fourth line, and so on are driven (the numbers in FIG. 30B indicate the driving order of the lines). Thus, as shown in FIG. 30C, the polarity signal POL changes 25 times, which is one time more than the case described using FIGS. 26A and 26B, within one frame (the numbers in FIG. 30B indicate the line number counted from the top of the screen).

Here, even in this case, as described using FIG. 28, when odd-line driving is switched to even-line driving and when even-line driving is switched to odd-line driving, as a matter of course, it is preferable that the time period for performing the operation of writing at the first line after switching is performed is set to be longer than other time periods for performing the operation of writing at other lines.

In this way, in the case described using FIG. 30, in a frame that is divided into twelve areas, switching is performed between sub-frames in such a manner that the position of each of the selected lines is made to be different between the sub-frames, and odd lines or even lines are driven in each of the sub-frames, whereby the power consumption can be suppressed and a necessary capacity of a memory can be smaller, compared with dot inversion driving. Furthermore, positions at which the polarity signal POL changes can be dispersedly set for even lines and odd lines, and thus the inconsistencies that tend to occur at these positions can be suppressed and the LCD panel 76 can be easily controlled.

As described above, even when a half tone is displayed using pixels having a multi-pixel structure, in the display device 51, since the operation of writing is performed using a group of pixel electrodes Px1 or a group of pixel electrodes Px2 in units of a sub-frame, the changes in voltage can be suppressed, whereby the power consumption can be prevented from becoming large. For example, when a uniform tone is displayed over the entire screen, no matter which tone is displayed, electric current flows the source bus lines for a moment when switching is performed between sub-frames and this happens only two times in one frame in such a case. In this way, in the display device 51, even when a halftone is displayed using pixels having a multi-pixel structure, the effects of vertical frame inversion can be utilized to the utmost and a problem of flicker and inconsistencies in the form of vertical streaks in a moving image can be greatly reduced by the polarity arrangement obtained in a state in which driving of two sub-frames is finished.

Moreover, in the display device 51, even in the case of pixels having a multi-pixel structure or in the case of pixels having a general structure, one screen is divided into a plurality of frames along the horizontal direction, switching is performed between sub-frames in the frames, and odd lines or even lines can be driven in each of the sub-frames, whereby the power consumption can be suppressed and a necessary capacity of a memory can be smaller, compared with dot inversion driving.

Moreover, in the display device 51, even in the case of pixels having a multi-pixel structure or in the case of pixels having a general structure, the position of each of the selected lines is made to be different between subsequent odd and even sub-frames, in other words, the position at which the polarity signal POL changes can be set for each sub-frame in such a manner that the position for the sub-frame does not overlap the position for another sub-frame. Thus, compared with dot inversion driving, the power consumption can be suppressed and a necessary capacity of a memory can be smaller. Furthermore, the inconsistencies that tend to occur at positions at which the polarity signal POL changes can be suppressed and the LCD panel 76 can be easily controlled.

Here, description has been made by treating the display device 51 as a single device; however, the LCD panel 76 may be a separate device and the remaining portion may be configured as a display control device, as a matter of course.

The present application contains subject matter related to that disclosed in Japanese Priority Patent Applications JP 2008-075696 and JP 2008-075697 filed in the Japan Patent Office on Mar. 24, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid crystal display device, comprising:

display means including liquid crystal display elements corresponding to pixels which have a multi-pixel structure and which are arranged in matrix;

first driving means for driving scanning lines connected to the liquid crystal display elements corresponding to the pixels;

second driving means for driving signal lines connected to the liquid crystal display elements corresponding to the pixels;

image acquisition means for acquiring an image signal to be displayed on the display means; and control means for controlling the first driving means and the second driving means in accordance with the image signal acquired by the image acquisition means, wherein, in the display means, each of the pixels, which has the multi-pixel structure and which is constituted by a first pixel and a second pixel, is connected to two corresponding signal lines, and first pixels and second pixels of pixels are connected to two corresponding signal lines in a checkerboard manner, the control means controls the first driving means in such a manner that all horizontal scanning lines of one frame are scanned by repeatedly scanning a first sub-frame in which only odd lines of horizontal scanning lines are scanned and a second sub-frame in which only even lines of horizontal scanning lines are scanned, and controls the second driving means in such a manner that the polarity of the first pixel of each of the pixels connected to the two corresponding signal lines differs from the polarity of the second pixel of the pixel, the polarities of the first pixels of adjacent pixels differ from each other, the polarities of the second pixels of adjacent pixels differ from each other, and a polarity signal is inverted when switching is performed between the first sub-frame and the second sub-frame, the control means divides all horizontal scanning lines of the display means into a plurality of areas constituted by four lines or more, and controls the first driving means in such a manner that all horizontal scanning lines of one frame are scanned by executing scanning of the first sub-frame and the second sub-frame in the plurality of areas, the control means sets a time period for performing an operation of writing at the first horizontal scanning line after switching is performed between the first sub-frame and the second sub-frame, to be longer than a time period for performing the operation of writing at another horizontal scanning line, and the first driving means and second driving means drive the liquid crystal display elements by a method other than dot inversion.

2. The liquid crystal display device according to claim 1, wherein the control means divides all horizontal scanning lines of the display means into a plurality of areas constituted by two lines or more in such a manner that scanning areas of the first sub-frame and second sub-frame do not overlap each other, and controls the first driving means in such a manner that all horizontal scanning lines of one frame are scanned by executing scanning of the first sub-frame and the second sub-frame in the plurality of areas.

3. The liquid crystal display device according to claim 2, wherein the control means sets a time period for performing an operation of writing at the first horizontal scanning line after switching is performed between the first sub-frame and the second sub-frame, to be longer than a time period for performing the operation of writing at another horizontal scanning line.

4. A liquid crystal display method for displaying an image on a liquid crystal display device which includes display means including liquid crystal display elements corresponding to pixels which have a multi-pixel structure and which are arranged in matrix;

first driving means for driving scanning lines connected to the liquid crystal display elements corresponding to the pixels; and second driving means for driving signal lines connected to the liquid crystal display elements corresponding to the pixels, and in the display means, each of the pixels, which has the multi-pixel structure and which is constituted by a first pixel and a second pixel, is connected to two corresponding signal lines, and first pixels and second pixels of pixels are connected to two corresponding signal lines in a checkerboard manner, the liquid crystal display method comprising the steps of:

acquiring an image signal corresponding to the image to be displayed on the display means;

when the first driving means and the second driving means are controlled in accordance with the acquired image signal, dividing all horizontal scanning lines of the display means into a plurality of areas constituted by four lines or more, and controlling the first driving means in such a manner that all horizontal scanning lines of one frame are scanned by repeatedly scanning a first sub-frame in which only odd lines of horizontal scanning lines are scanned and a second sub-frame in which only even lines of horizontal scanning lines are scanned in the plurality of areas;

controlling the second driving means in such a manner that the polarity of the first pixel of each of the pixels connected to the two corresponding signal lines differs from the polarity of the second pixel of the pixel, the polarities of the first pixels of adjacent pixels differ from each other, the polarities of the second pixels of adjacent pixels differ from each other, and a polarity signal is inverted when switching is performed between the first sub-frame and the second sub-frame, wherein the time period for performing an operation of writing at the first horizontal scanning line after switching is performed between the first sub-frame and the second sub-frame is longer than a time period for performing the operation of writing at another horizontal scanning line, and the first driving means and second driving means drive the liquid crystal display elements by a method other than dot inversion.

5. The liquid crystal display method according to claim 4, wherein the control means divides all horizontal scanning lines of the display means into a plurality of areas constituted by two lines or more in such a manner that scanning areas of the first sub-frame and second sub-frame do not overlap each other, and controls the first driving means in such a manner that all horizontal scanning lines of one frame are scanned by executing scanning of the first sub-frame and the second sub-frame in the plurality of areas.

6. The liquid crystal display method according to claim 5, wherein the control means sets a time period for performing an operation of writing at the first horizontal scanning line after switching is performed between the first sub-frame and the second sub-frame, to be longer than a time period for performing the operation of writing at another horizontal scanning line.

7. A liquid crystal display device, comprising:

a display unit including liquid crystal display elements corresponding to pixels which have a multi-pixel structure and which are arranged in matrix;

a first driving unit that drives scanning lines connected to the liquid crystal display elements corresponding to the pixels;

a second driving unit that drives signal lines connected to the liquid crystal display elements corresponding to the pixels;

an image acquisition unit that acquires an image signal to be displayed on the display unit; and a control unit that controls the first driving unit and the second driving unit in accordance with the image signal acquired by the image acquisition unit, wherein, in the display unit, each of the pixels, which has the multi-pixel structure and which is constituted by a first pixel and a second pixel, is connected to two corresponding signal lines, and first pixels and second pixels of pixels are connected to two corresponding signal lines in a checkerboard manner, the control unit divides all horizontal scanning lines of the display unit into a plurality of areas constituted by four lines or more, and controls the first driving unit in such a manner that all horizontal scanning lines of one frame are scanned by executing scanning of the first sub-frame and the second sub-frame in the plurality of areas, controls the first driving unit in such a manner that all horizontal scanning lines of one frame are scanned by repeatedly scanning a first sub-frame in which only odd lines of horizontal scanning lines are scanned and a second sub-frame in which only even lines of horizontal scanning lines are scanned, sets a time period for performing an operation of writing at the first horizontal scanning line after switching is performed between the first sub-frame and the second sub-frame, to be longer than a time period for performing the operation of writing at another horizontal scanning line, and controls the second driving unit in such a manner that the polarity of the first pixel of each of the pixels connected to the two corresponding signal lines differs from the polarity of the second pixel of the pixel, the polarities of the first pixels of adjacent pixels differ from each other, the polarities of the second pixels of adjacent pixels differ from each other, and a polarity signal is inverted when switching is performed between the first sub-frame and the second sub-frame, and the first driving unit and second driving unit drive the liquid crystal display elements by a method other than dot inversion.

8. The liquid crystal display device according to claim 7, wherein the control unit divides all horizontal scanning lines of the display unit into a plurality of areas constituted by two lines or more in such a manner that scanning areas of the first sub-frame and second sub-frame do not overlap each other, and controls the first driving unit in such a manner that all horizontal scanning lines of one frame are scanned by executing scanning of the first sub-frame and the second sub-frame in the plurality of areas.

9. The liquid crystal display device according to claim 8, wherein the control unit sets a time period for performing an operation of writing at the first horizontal scanning line after switching is performed between the first sub-frame and the second sub-frame, to be longer than a time period for performing the operation of writing at another horizontal scanning line.

10. A liquid crystal display device, comprising:

display means including liquid crystal display elements corresponding to pixels which are arranged in matrix;

first driving means for driving scanning lines connected to the liquid crystal display elements corresponding to the pixels;

second driving means for driving signal lines connected to the liquid crystal display elements corresponding to the pixels;

image acquisition means for acquiring an image signal to be displayed on the display means; and control means for controlling the first driving means and the second driving means in accordance with the image signal acquired by the image acquisition means, wherein the control means controls the first driving means in such a manner that all horizontal scanning lines of the display means are divided into a plurality of areas and all horizontal scanning lines of one frame are scanned by executing scanning of a first sub-frame in which only odd lines of horizontal scanning lines are scanned and scanning of a second sub-frame in which only even lines of horizontal scanning lines are scanned in the plurality of areas, and a time period for performing an operation of writing at the first horizontal scanning line after switching is performed between the first sub-frame and the second sub-frame is set to be longer than a time period for performing the operation of writing at another horizontal scanning line, the control means controls the second driving means in such a manner that a polarity signal is inverted when switching is performed between the first sub-frame and the second sub-frame, and the first driving means and second driving means drive the liquid crystal display elements by a method other than dot inversion.

11. The liquid crystal display device according to claim 10, wherein the control means controls the first driving means and the second driving means in such a manner that positions at which the polarity signal is inverted when switching is performed between the first sub-frame and the second sub-frame do not overlap each other.

12. A liquid crystal display method for a liquid crystal display device which includes display means including liquid crystal display elements corresponding to pixels which are arranged in matrix;

first driving means for driving scanning lines connected to the liquid crystal display elements corresponding to the pixels; and second driving means for driving signal lines connected to the liquid crystal display elements corresponding to the pixels, the liquid crystal display method comprising the steps of:

acquiring an image signal to be displayed on the display means; and when the first driving means and the second driving means are controlled in accordance with the acquired image signal, controlling the first driving means and the second driving means in such a manner that all horizontal scanning lines of the display means are divided into a plurality of areas and all horizontal scanning lines of one frame are scanned by executing scanning of a first sub-frame in which only odd lines of horizontal scanning lines are scanned and scanning of a second sub-frame in which only even lines of horizontal scanning lines are scanned in the plurality of areas, a polarity signal is inverted when switching is performed between the first sub-frame and the second sub-frame, a time period for performing an operation of writing at the first horizontal scanning line after switching is performed between the first sub-frame and the second sub-frame is set to be longer than a time period for performing the operation of writing at another horizontal scanning line, and the first driving means and second driving means drive the liquid crystal display elements by a method other than dot inversion.

13. The liquid crystal display method according to claim 12, wherein the control means divides all horizontal scanning lines of the display means into a plurality of areas constituted by two lines or more in such a manner that scanning areas of the first sub-frame and second sub-frame do not overlap each other, and controls the first driving means in such a manner that all horizontal scanning lines of one frame are scanned by executing scanning of the first sub-frame and the second sub-frame in the plurality of areas.

14. The liquid crystal display method according to claim 13, wherein the control means sets a time period for performing an operation of writing at the first horizontal scanning line after switching is performed between the first sub-frame and the second sub-frame, to be longer than a time period for performing the operation of writing at another horizontal scanning line.

15. The liquid crystal display method according to claim 12, wherein the control means divides all horizontal scanning lines of the display means into a plurality of areas constituted by four lines or more, and controls the first driving means in such a manner that all horizontal scanning lines of one frame are scanned by executing scanning of the first sub-frame and the second sub-frame in the plurality of areas.

16. The liquid crystal display method according to claim 15, wherein the control means sets a time period for performing an operation of writing at the first horizontal scanning line after switching is performed between the first sub-frame and the second sub-frame, to be longer than a time period for performing the operation of writing at another horizontal scanning line.

17. A liquid crystal display device, comprising:

a display unit that includes liquid crystal display elements corresponding to pixels which are arranged in matrix;

a first driving unit that drives scanning lines connected to the liquid crystal display elements corresponding to the pixels;

a second driving unit that drives signal lines connected to the liquid crystal display elements corresponding to the pixels;

an image acquisition unit that acquires an image signal to be displayed on the display unit; and a control unit that controls the first driving unit and the second driving unit in accordance with the image signal acquired by the image acquisition unit, wherein the control unit controls the first driving unit in such a manner that all horizontal scanning lines of the display unit are divided into a plurality of areas and all horizontal scanning lines of one frame are scanned by executing scanning of a first sub-frame in which only odd lines of horizontal scanning lines are scanned and scanning of a second sub-frame in which only even lines of horizontal scanning lines are scanned in the plurality of areas, and a time period for performing an operation of writing at the first horizontal scanning line after switching is performed between the first sub-frame and the second sub-frame is set to be longer than a time period for performing the operation of writing at another horizontal scanning line, the control unit controls the second driving unit in such a manner that a polarity signal is inverted when switching is performed between the first sub-frame and the second sub-frame, and the first driving means and second driving means drive the liquid crystal display elements by a method other than dot inversion.

18. The liquid crystal display device according to claim 17, wherein the control unit divides all horizontal scanning lines of the display unit into a plurality of areas constituted by two lines or more in such a manner that scanning areas of the first sub-frame and second sub-frame do not overlap each other, and controls the first driving unit in such a manner that all horizontal scanning lines of one frame are scanned by executing scanning of the first sub-frame and the second sub-frame in the plurality of areas.

19. The liquid crystal display device according to claim 18, wherein the control unit sets a time period for performing an operation of writing at the first horizontal scanning line after switching is performed between the first sub-frame and the second sub-frame, to be longer than a time period for performing the operation of writing at another horizontal scanning line.

20. The liquid crystal display device according to claim 17, wherein the control unit divides all horizontal scanning lines of the display unit into a plurality of areas constituted by four lines or more, and controls the first driving unit in such a manner that all horizontal scanning lines of one frame are scanned by executing scanning of the first sub-frame and the second sub-frame in the plurality of areas.

21. The liquid crystal display device according to claim 20, wherein the control unit sets a time period for performing an operation of writing at the first horizontal scanning line after switching is performed between the first sub-frame and the second sub-frame, to be longer than a time period for performing the operation of writing at another horizontal scanning line.

* * * * *